US008836633B2

(12) United States Patent
Tsai et al.

(10) Patent No.: US 8,836,633 B2
(45) Date of Patent: Sep. 16, 2014

(54) DISPLAY DRIVING CIRCUIT AND DISPLAY PANEL USING THE SAME

(75) Inventors: Yi-Cheng Tsai, Miao-Li County (TW); Hung-Chih Sun, Miao-Li County (TW); Gau-Bin Chang, Miao-Li County (TW); Yi-Yuan Lin, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 303 days.

(21) Appl. No.: 13/352,866

(22) Filed: Jan. 18, 2012

(65) Prior Publication Data

US 2012/0188211 A1 Jul. 26, 2012

(30) Foreign Application Priority Data

Jan. 20, 2011 (TW) ..... 100102170 A

(51) Int. Cl.
*G09G 3/36* (2006.01)
*G09G 3/20* (2006.01)

(52) U.S. Cl.
CPC ..... *G09G 3/20* (2013.01); *G09G 2310/0283* (2013.01); *G09G 2310/0286* (2013.01); *G09G 2320/045* (2013.01)
USPC ..... 345/100; 345/205; 345/214; 345/61

(58) Field of Classification Search
USPC ..... 345/205, 699, 100, 214, 61; 377/69, 64, 377/67
See application file for complete search history.

(56) References Cited

U.S. PATENT DOCUMENTS 7,136,041 B2 11/2006 Park
7,327,161 B2 2/2008 Jang et al.
7,397,885 B2 7/2008 Moon et al.
7,583,247 B2 9/2009 Park et al.
7,656,381 B2 * 2/2010 Luo ..... 345/100
2004/0125069 A1 * 7/2004 Park et al. ..... 345/100
2005/0195150 A1 * 9/2005 Etoh et al. ..... 345/100
2007/0159502 A1 * 7/2007 Luo ..... 345/698
2007/0171243 A1 * 7/2007 Luo ..... 345/699
2007/0274433 A1 11/2007 Tobita
2011/0002438 A1 * 1/2011 Kim ..... 377/67
2011/0122988 A1 * 5/2011 Miyayama et al. ..... 377/64
2011/0150169 A1 * 6/2011 Lin et al. ..... 377/64
2012/0114092 A1 * 5/2012 Kim ..... 377/69

FOREIGN PATENT DOCUMENTS

CN 101079243 11/2007

OTHER PUBLICATIONS

Office Action dated Dec. 26, 2013 from corresponding application No. CN 201110026471.6.

* cited by examiner

*Primary Examiner* — Thuy Pardo
(74) *Attorney, Agent, or Firm* — Rabin & Berdo, P.C.

(57) ABSTRACT

In a display driving circuit, odd-stage shift registers (SRs) are cascaded; and even-stage SRs are cascaded. The SRs support dual direction shifting. Each SR includes: first, second, third, and fourth transistors. The first transistor is coupled to a forward scan start signal from a third transistor of a former second SR, coupled to an output signal from the former second SR and coupled to a node. The second transistor is coupled to a reverse scan start signal from a fourth transistor of a next second SR, coupled to an output signal from the next second SR and coupled to the node. The third transistor is coupled to a forward operation voltage and coupled to the node, and further outputs a forward scan start signal. The fourth transistor is coupled to a reverse operation voltage and coupled to the node, and further outputs a reverse scan start signal.

16 Claims, 22 Drawing Sheets

DISPLAY DRIVING CIRCUIT AND DISPLAY PANEL USING THE SAME

This application claims the benefit of Taiwan application Serial No. 100102170, filed Jan. 20, 2011, the subject matter of which is incorporated herein by reference.

TECHNICAL FIELD

The disclosure relates in general to a display driving circuit and a display panel using the same, and more particularly to a gate on panel (GOP) display driving circuit supporting dual direction scanning, and a display panel using the same.

BACKGROUND

A liquid crystal display panel has advantages of light weight, long lifetime and high definition so that it is widely applied to various electronic devices, such as a mobile telephone, a television, a computer display and the like. In the prior art, a gate driving circuit is formed on an external hard printed circuit board. This disclosure discloses a liquid crystal display panel using a gate on panel (GOP) technique, in which some or all gate driving circuits for driving scan lines are formed on a substrate of the liquid crystal display panel during manufacture of a thin film transistor array. This technique may also be referred to as an amorphous silicon gate (ASG) or a gate in panel (GIP) technique. In this manner, complexity and size of the external gate driving circuit are reduced, while the manufacturing cost of the panel is decreased.

For the current GOP technique, however, in case that one direction scanning (one direction shifting) function is provided, if a reverse scanning (reverse shifting) is required, the design of the original display driving circuit cannot be shared, and the mask thereof must be manufactured again. Because the cost of the mask is significantly increased with the increase of the size, a display driving circuit with the dual direction scanning (dual direction shifting) function becomes more and more important and is gradually required.

SUMMARY OF THE DISCLOSURE

The disclosure is directed to a gate on panel (GOP) display apparatus, which implements the dual direction scanning (dual direction shifting) function and increases the circuit stability.

The disclosure is directed to a GOP display apparatus, which implements the dual direction scanning (dual direction shifting) function and may suppress a current leakage path and lower abnormal risk of circuit operations.

According to an example of the present disclosure, a display driving circuit formed on a thin film transistor array substrate is provided. The display driving circuit includes a plurality of shift registers, odd-stage shift registers thereof cascaded and even-stage shift registers thereof cascaded. The shift registers support dual direction shifting. Each of the shift registers includes a first transistor, a second transistor, a third transistor, and a fourth transistor. The first transistor is coupled to a forward scan start signal outputted from a third transistor of a former second-stage shift register, coupled to an output signal of the former second-stage shift register, and coupled to a node. The second transistor is coupled to a reverse scan start signal outputted from a fourth transistor of a next second-stage shift register, coupled to an output signal outputted from the next second-stage shift register, and coupled to the node. The third transistor is coupled to a forward operation voltage and the node, and outputs a forward scan start signal. The fourth transistor is coupled to a reverse operation voltage and the node, and outputs a reverse scan start signal.

According to another example of the present disclosure, a display panel including a thin film transistor array substrate, a plurality of scan lines and a driving circuit is provided. The scan lines are formed on the thin film transistor array substrate. The driving circuit, formed on the thin film transistor array substrate, drives the scan lines. The display driving circuit includes a plurality of shift registers, odd-stage shift registers thereof cascaded and even-stage shift registers thereof cascaded. The shift registers support dual direction shifting. Each of the shift registers includes a first transistor, a second transistor, a third transistor, and a fourth transistor. The first transistor is coupled to a forward scan start signal outputted from a third transistor of a former second-stage shift register, coupled to an output signal of the former second-stage shift register, and coupled to a node. The second transistor is coupled to a reverse scan start signal outputted from a fourth transistor of a next second-stage shift register, coupled to an output signal outputted from the next second-stage shift register, and coupled to the node. The third transistor is coupled to a forward operation voltage and the node, and outputs a forward scan start signal. The fourth transistor is coupled to a reverse operation voltage and the node, and outputs a reverse scan start signal.

It is to be understood that both the foregoing general description and the following detailed description are exemplary and explanatory only and are not restrictive of the disclosed embodiments, as claimed.

DETAILED DESCRIPTION OF THE DISCLOSURE

Figure 1:
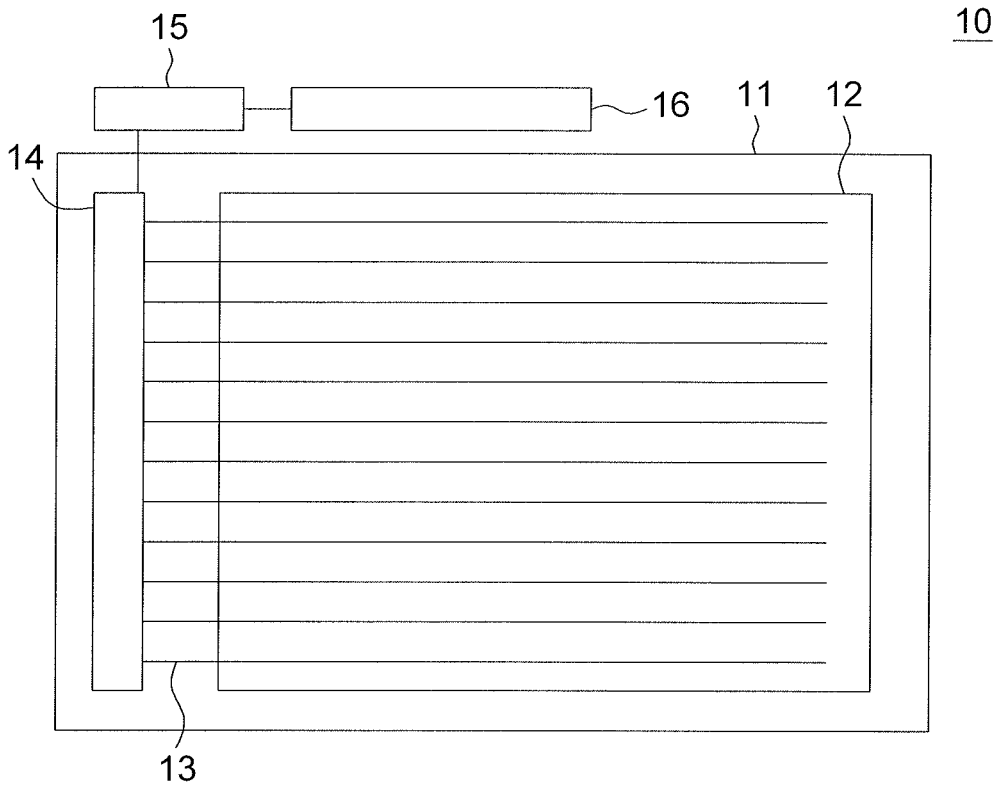
FIG. 1 is a schematic illustration showing a display panel using the amorphous silicon gate technique.

FIG. 1 is a schematic illustration showing a display panel 10 using the amorphous silicon gate technique. Referring to FIG. 1, the display panel 10 includes a glass substrate 11, multiple scan lines 13, a GOP driving circuit 14, an external level shifter 15 and a timing controller 16. The glass substrate 11 has a pixel area (active area) 12 and each scan line 13 is partially disposed in the pixel area 12. The GOP driving circuit 14 is disposed on one side of the glass substrate 11. The GOP driving circuit 14 includes multiple shift registers electrically connected to the scan lines 13 to drive the scan lines 13. The timing controller 16 outputs multiple control signals and multiple clock signals. The control signals and the clock signals are boosted by the external level shifter 15 and then transferred to the GOP driving circuit 14 to drive the scan lines 13 to display a frame. The timing controller 16 and the external level shifter 15 are not formed on the glass substrate 11, but are formed on, for example, a hard printed circuit board. A chip on film (COF) connects the hard printed circuit board to the glass substrate, so that the control signals and the clock signals, outputted from the timing controller 16, are boosted by the external level shifter 15 and transferred to the GOP driving circuit 14 on the glass substrate 11 through the COF.

In the following, for the sake of illustration, the direction of a forward scanning (forward shifting) is defined as from a top scan line to a bottom scan line, and the direction of a reverse scanning (reverse shifting) is defined as from the bottom scan line to the top scan line.

First Embodiment

Figure 2A:
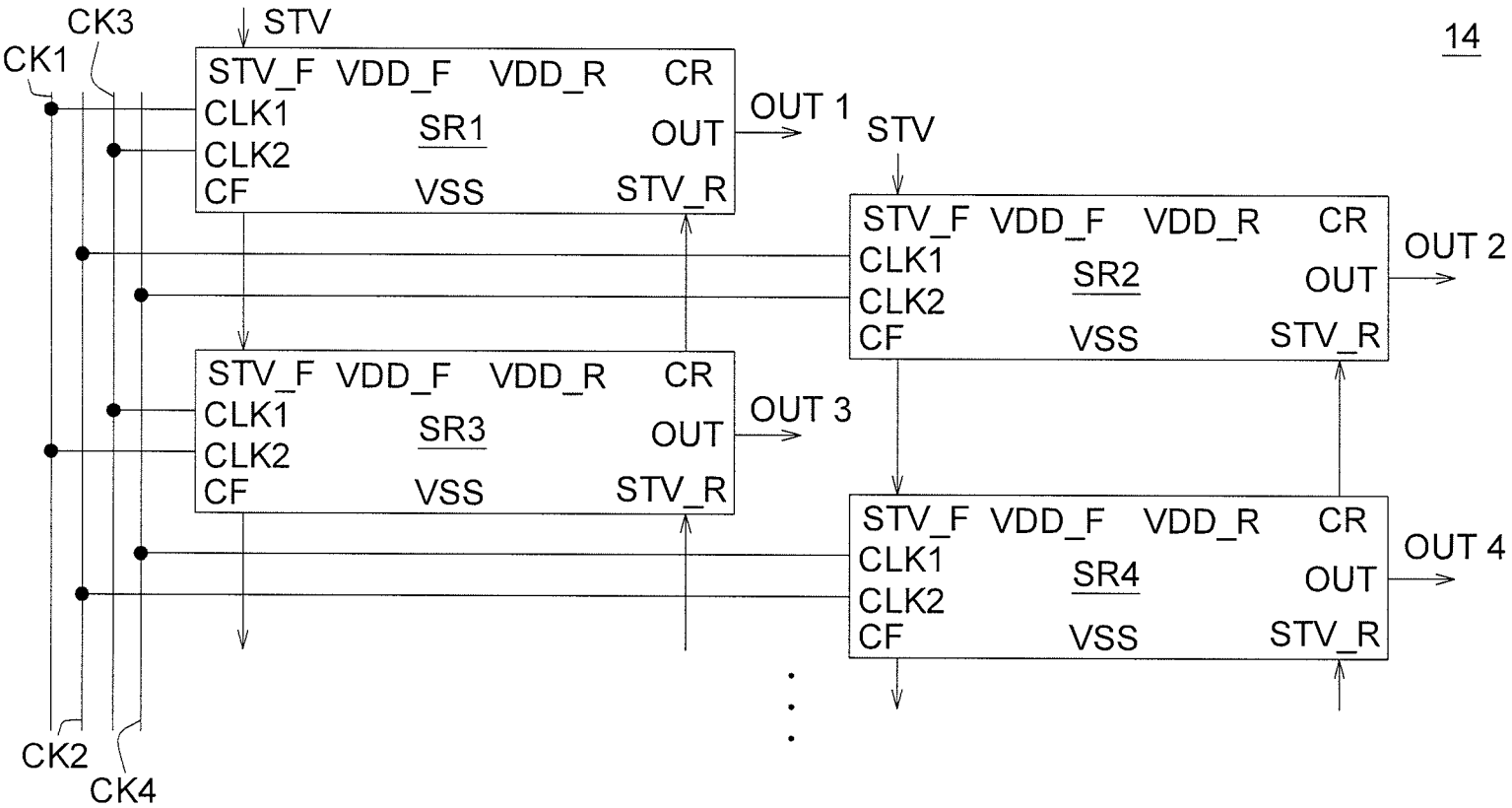
FIGS. 2A and 2B are schematic illustrations showing a GOP driving circuit according to a first embodiment of the disclosure.
Figure 2B:
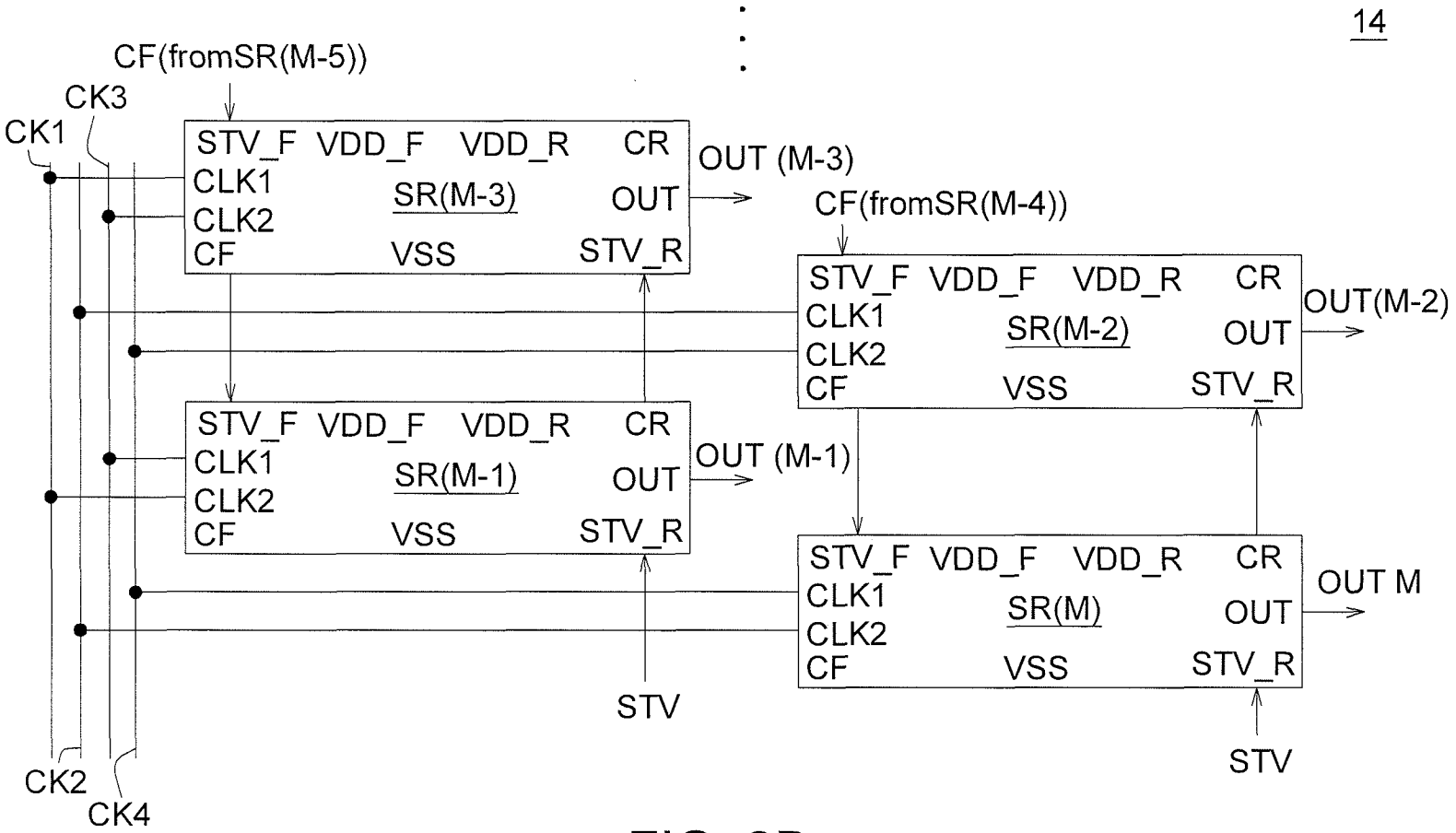

FIGS. 2A and 2B are schematic illustrations showing the GOP driving circuit 14 according to a first embodiment of the disclosure. Herein, it is assumed that the GOP driving circuit includes M shift registers (SR), where M is for example a positive even integer. The timing controller outputs clock signals CK1 to CK4 and a start pulse STV. The odd-stage shift registers are cascaded, and the even-stage shift registers are cascaded in the manners to be described in the following. The shift registers SR1 to SRM support dual direction (forward and reverse) shifting.

As shown in FIG. 2A, for the odd-stage SRs, a first-stage shift register SR1 receives the start signal STV as a forward scan start signal, receives an output signal CR (carry reverse, representing a reverse CARRY signal) from the third-stage shift register SR3 as its reverse start signal (STV_R) and further receives the clock signals CK1 and CK3. The third-stage shift register SR3 receives an output signal CF (carry forward, representing a forward CARRY signal) from the first-stage shift register SR1 as its forward start signal (STV_F), receives the output signal CR from the fifth-stage shift register SR5 as its reverse start signal (STV_R) and further receives the clock signals CK1 and CK3. The other details can be obtained analogically. For the even-stage SRs, the second-stage shift register SR2 receives the start signal STV as its forward scan start signal, receives the output signal CR from the fourth-stage shift register SR4 as its reverse start signal and further receives the clock signals CK2 and CK4. The fourth-stage shift register SR4 receives the signal CF from the second-stage shift register SR2 as its forward scan start signal, receives the output signal CR from the sixth-stage shift register SR6 as its reverse start signal and further receives the clock signals CK2 and CK4. The other details can be obtained analogically.

As shown in FIG. 2B, for the even-stage SRs, the $M^{th}$-stage shift register SRM receives the start signal STV as its reverse scan start signal (STV_R), receives the signal CF from the $(M-2)^{th}$-stage shift register SR(M−2) as its forward scan start signal and further receives the clock signals CK2 and CK4. The $(M-2)^{th}$-stage shift register SR(M−2) receives the output signal CR of the $M^{th}$-stage shift register SRM as its reverse scan start signal, receives the signal CF from the $(M-4)^{th}$-stage shift register SR(M−4) as its forward scan start signal and further receives the clock signals CK2 and CK4. The other details can be obtained analogically. Similarly, for the odd-stage SRs, the $(M-1)^{th}$-stage shift register SR(M−1) receives the start signal STV as its reverse scan start signal, receives the signal CF from the $(M-3)^{th}$-stage shift register SR(M−3) as its forward scan start signal and further receives the clock signals CK1 and CK3. The $(M-3)^{th}$-stage shift register SR(M−3) receives the output signal CR of the shift register SR(M−1) as its reverse scan start signal, receives the signal CF from the $(M-5)^{th}$-stage shift register SR(M−5) as its forward scan start signal and further receives the clock signals CK1 and CK3. The other details can be obtained analogically.

FIGS. 3A to 3E are circuit architecture diagrams showing the shift registers SR1, SR2, SR3, SRM−1 and SRM according to the first embodiment of the disclosure. Each shift register includes transistors T1 to T15. Basically, the shift registers have the same circuit architecture except that its input and output signals are different.

Figure 3A:
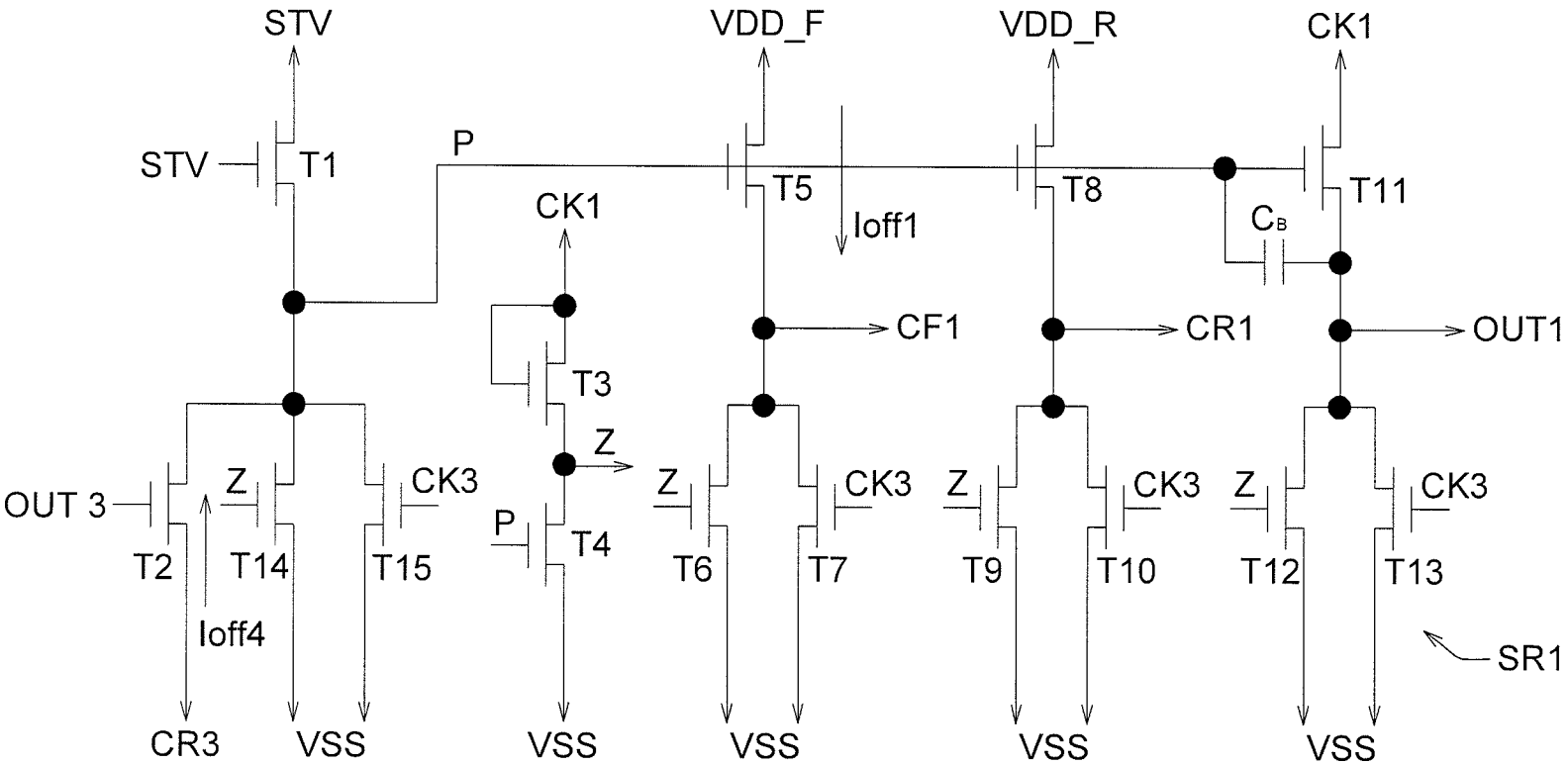
FIGS. 3A to 3E are circuit architecture diagrams showing shift registers according to the first embodiment of the disclosure.

As shown in FIG. 3A, for the first-stage shift register SR1, the transistor T1 has a gate and a drain for receiving the start signal STV, and a source connected to a node P. The transistor T2 has a source for receiving the signal CR3 outputted from the next second-stage shift register SR3 as the reverse scan start signal of the first-stage shift register SR1, a gate for receiving the signal OUT3 outputted from the next second-stage shift register SR3, and a drain connected to the node P. The transistor T3 has a gate and a drain both for receiving the clock signal CK1, and a source connected to a node Z. The transistor T4 has a source coupled to a ground VSS, a gate connected to the node P, and a drain connected to the node Z. The transistor T5 has a drain connected to a forward operation voltage VDD_F, a gate connected to the node P, and a source for outputting the signal CH1, the signal CF inputted to the transistor T1 of the next second-stage shift register SR3 as the forward scan start signal of the next second-stage shift register SR3. The transistor T5 is mainly in charge of the forward shifting. The transistors T6 and T7 have sources coupled to the ground VSS, gates respectively connected to the node Z and the clock signal CK3, and drains connected to the signal CF1. The transistor T8 has a drain connected to the reverse operation voltage VDD_R, a gate connected to the node P, and a source for outputting the signal CR1. The transistors T9 and T10 have sources coupled to the ground VSS, gates respectively connected to the node Z and the clock signal CK3, and drains connected to the signal CR1. The transistor T11 has a drain connected to the clock signal CK1, a gate connected to the node P, and a source for outputting the signal OUT1. The transistors T12 and T13 have sources coupled to the ground VSS, gates respectively connected to the node Z and the clock signal CK3, and drains connected to the signal OUT1. The transistors T14 and T15 have sources coupled to the ground VSS, gates respectively connected to the node Z and the clock signal CK3, and drains connected to the node P.

Figure 3B:
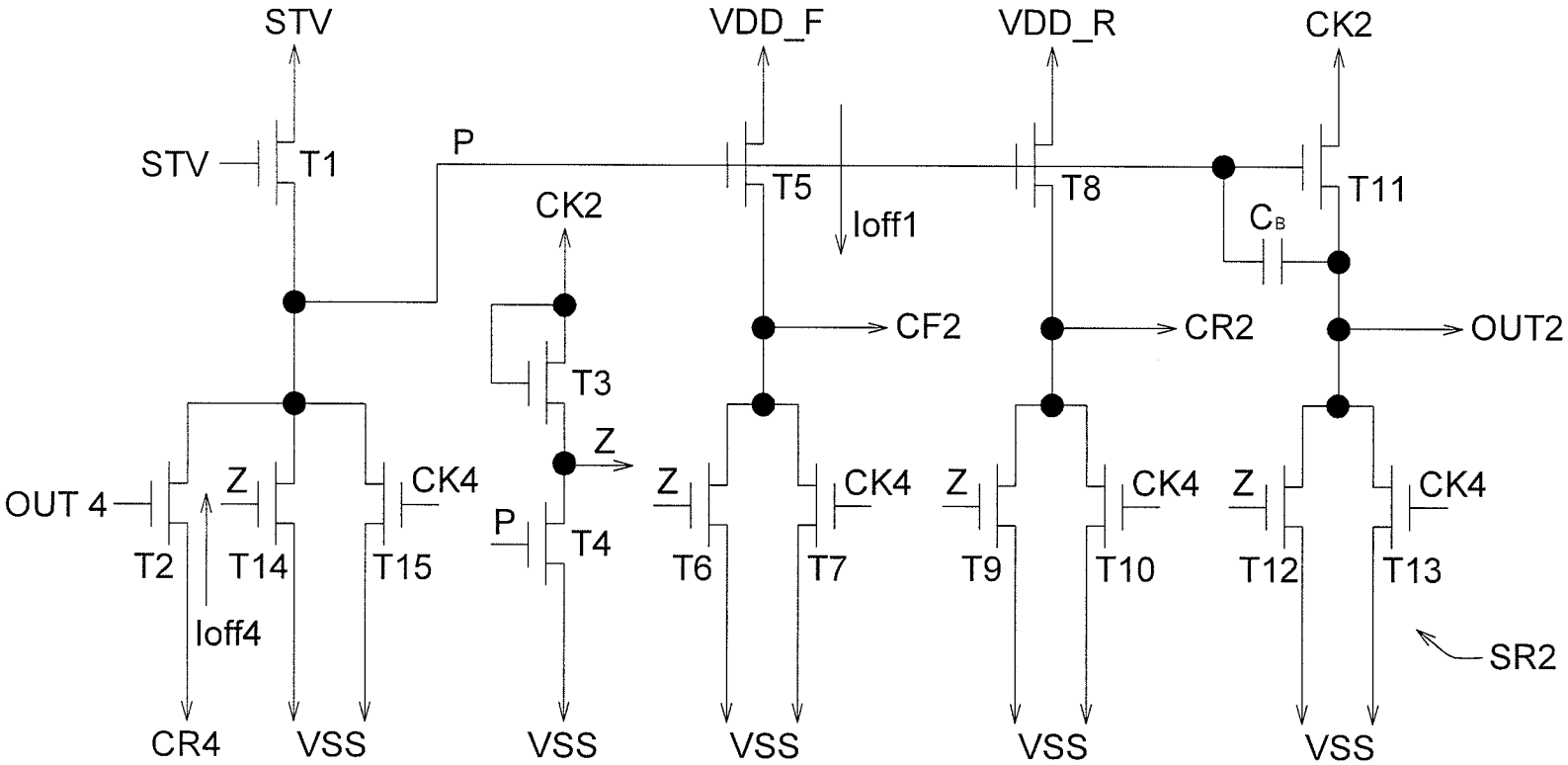

As shown in FIG. 3B, as for the second-stage shift register SR2, the transistors thereof have connections similar to those of FIG. 3A, and its details will not be repeated. The transistors T3 and T11 of the second-stage shift register SR2 receive the clock signal CK2, and the transistors T7, T10, T13 and T15 receive the clock signal CK4.

Figure 3C:
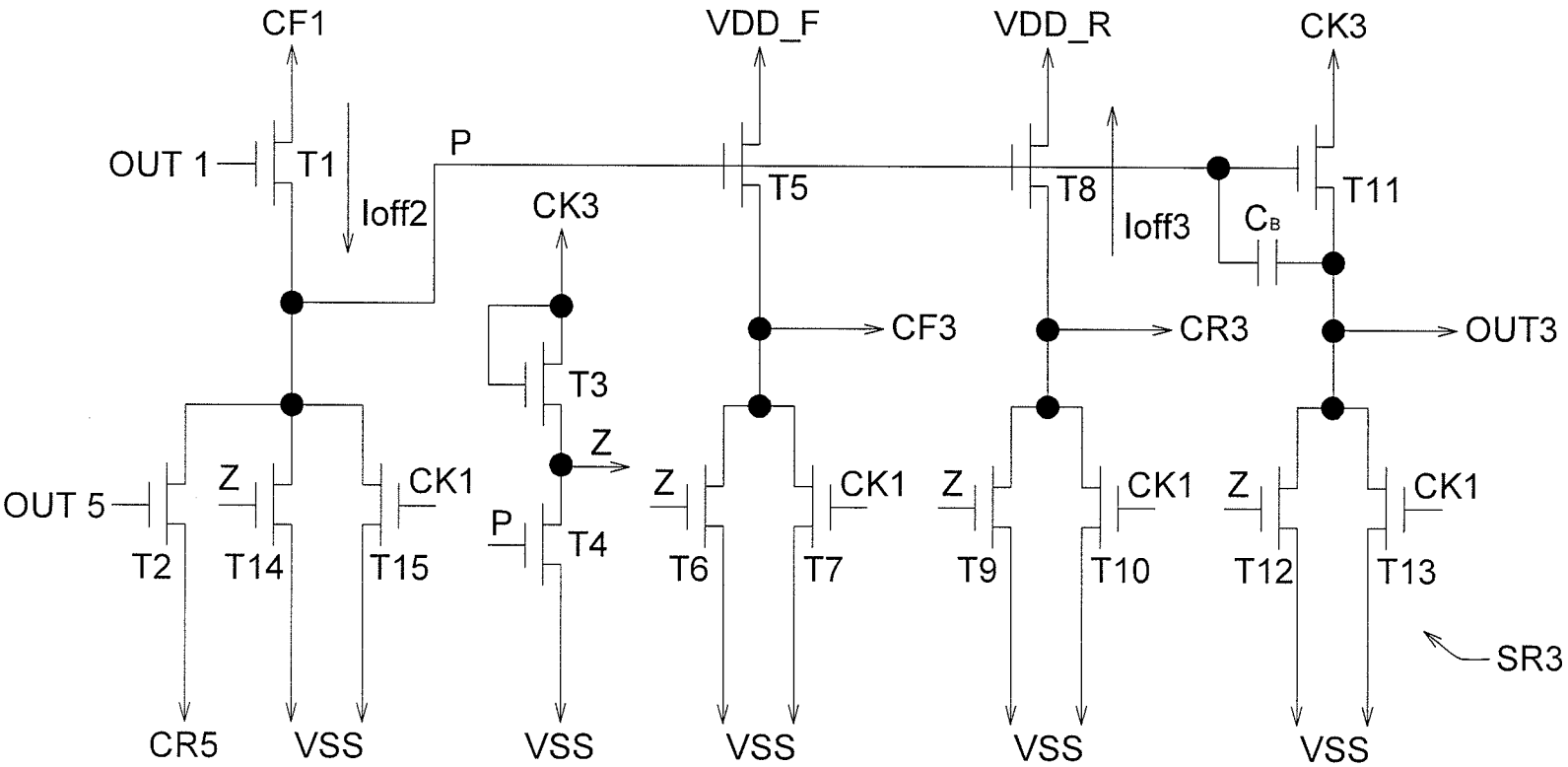

As shown in FIG. 3C, as for the shift register SR3, the transistor has a gate for receiving the signal OUT1 outputted from the former second-stage shift register SR1, and a drain for receiving the signal CF1, outputted from the transistor T5 of the former second-stage shift register SR1, as the forward scan start signal, and a source connected to the node P. The transistor T2 has a source receiving the signal CR5, outputted from the next second-stage shift register SR5, as its reverse scan start signal, a gate receiving the signal OUT5 outputted from the next second-stage shift register SR5, and a drain connected to the node P. The transistor T5 has a drain connected to the forward operation voltage VDD_F, a gate connected to the node P, and a source outputting the signal CF3, which is inputted to the transistor T1 of the next second-stage shift register SR5 as the forward scan start signal of the next second-stage shift register SR5. The transistor T5 is mainly in charge of the forward shifting. The transistor T8 has a drain connected to the reverse operation voltage VDD_R, a gate connected to the node P, and a source outputting the signal CR3. The output signal CR3 of the source of the transistor T8 of the shift register SR3 is inputted to the source of the transistor T2 of the former second-stage shift register SR1 as the reverse scan start signal of the former second-stage shift register SR1. The transistor T8 is mainly in charge of reverse shifting.

In addition, in the first-stage shift register SR1, the transistors T3 and T11 receive the clock signal CK1, while the transistors T7, T10, T13 and T15 receive the clock signal CK3. In the third-stage shift register SR3, however, the transistors T3 and T11 receive the clock signal CK3, while the transistors T7, T10, T13 and T15 receive the clock signal CK1.

Figure 3D:
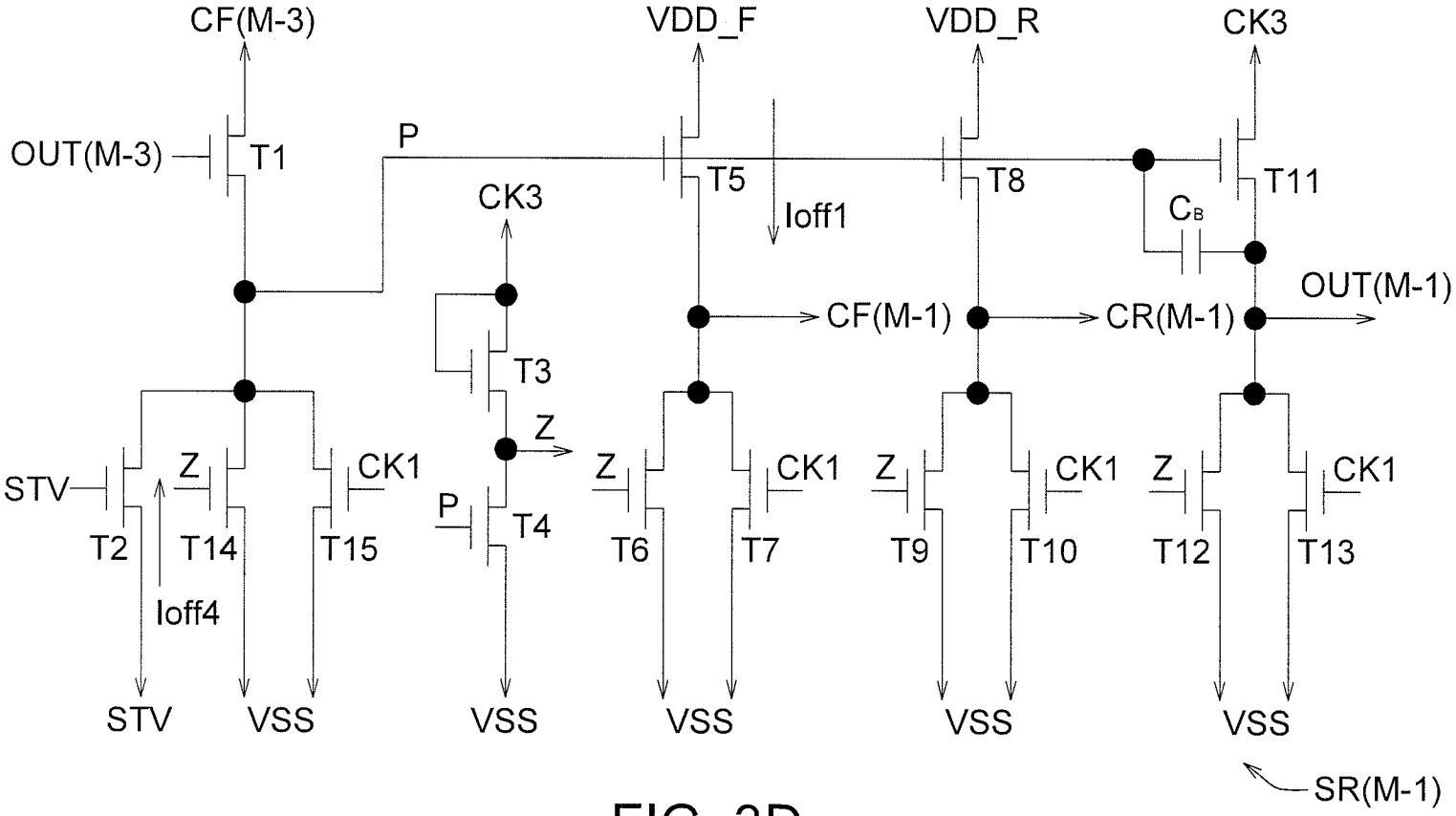

As shown in FIG. 3D, for the $(M-1)^{th}$-stage shift register SR(M−1), the transistor T1 has a gate receiving the signal OUT(M−3), a drain receiving the signal CF(M−3), and a source connected to the node P. The transistor T2 has a gate and a source both receiving the start signal STV as its reverse scan start signal, and a drain connected to the node P. The other circuit architecture is the same as that of FIG. 3A, and detailed descriptions thereof will be omitted.

Figure 3E:
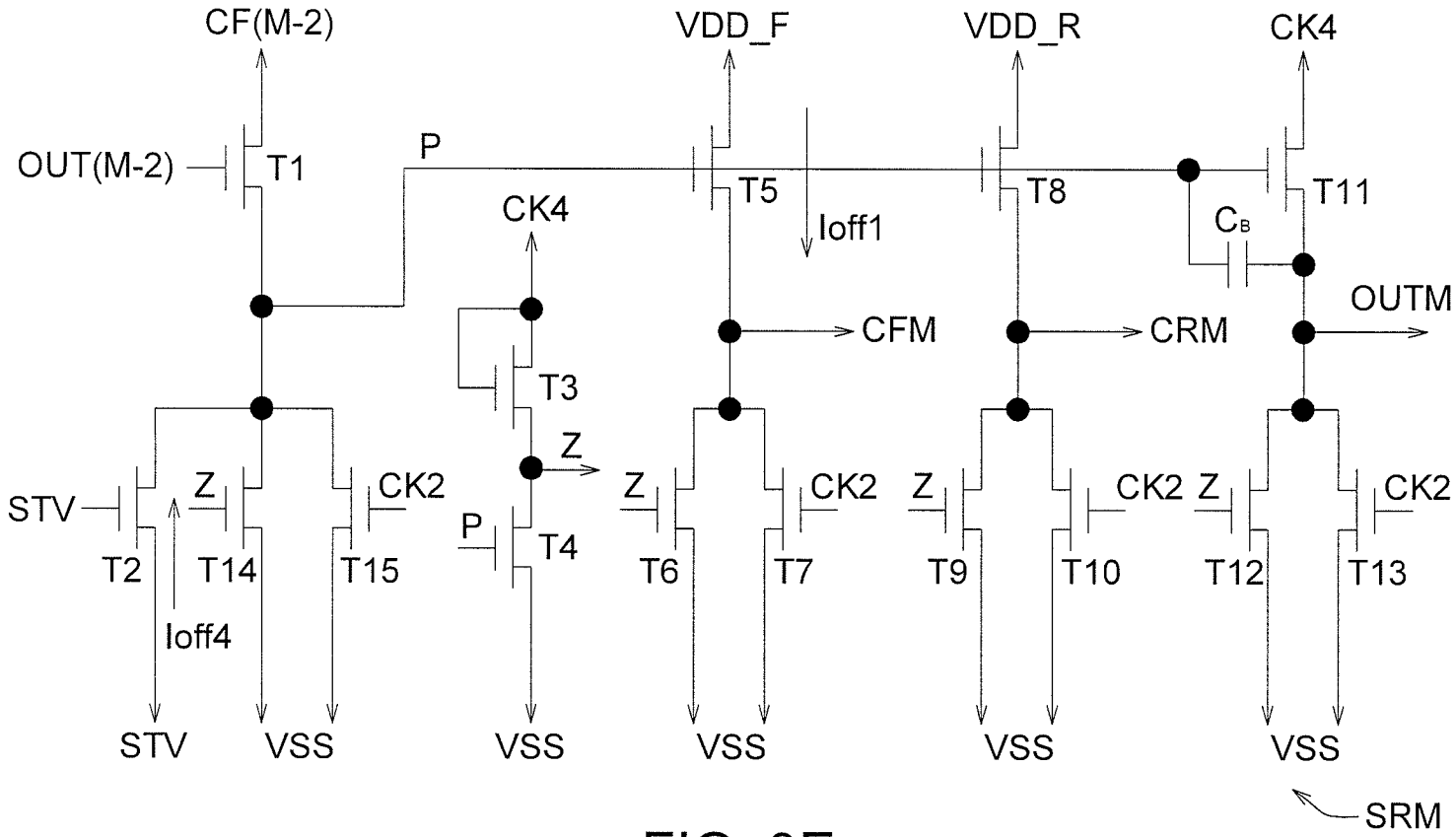

As shown in FIG. 3E, for the $M^{th}$-stage shift register SRM, the transistor T1 has a gate receiving the signal OUT(M−2), a drain receiving the signal CF(M−2), and a source connected to the node P. The transistor T2 has a gate and a source both receiving the start signal STV as its reverse scan start signal, and a drain connected to the node P. The other circuit architecture is the same as that of FIG. 3A, and detailed descriptions thereof will be omitted.

Figure 4A:
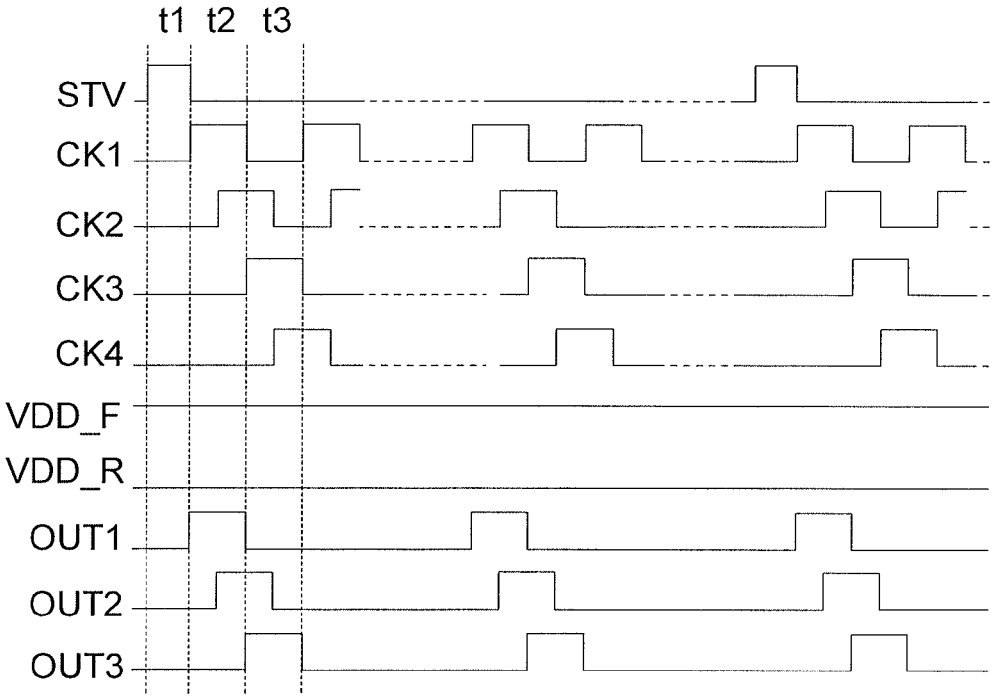
FIG. 4A shows a forward scan timing chart according to the first embodiment of the disclosure.
Figure 4B:
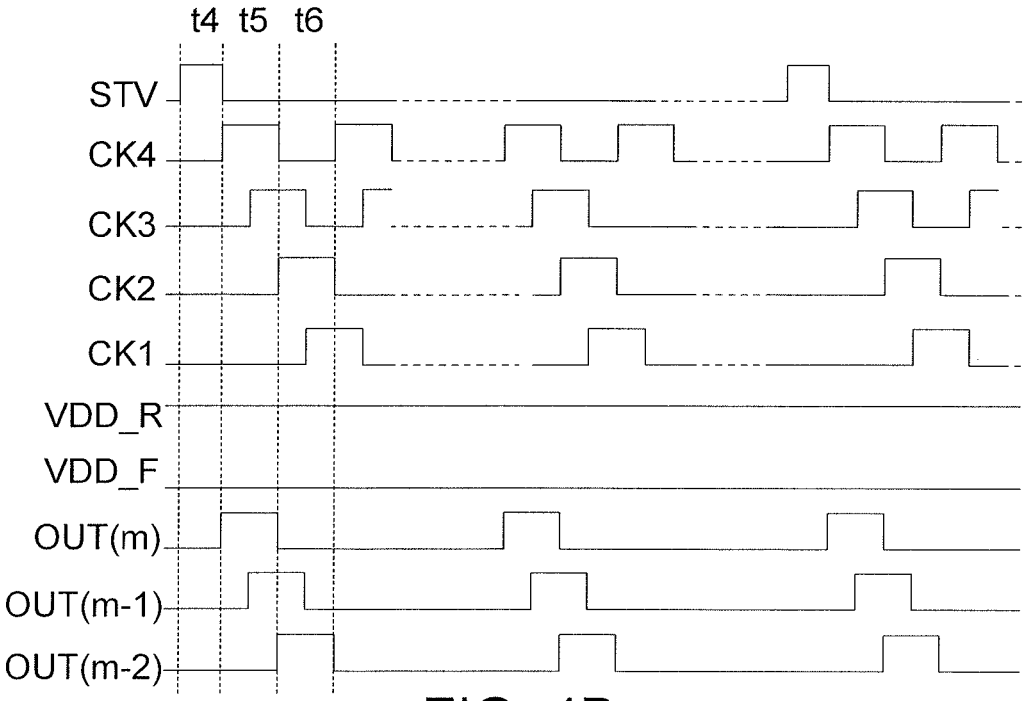
FIG. 4B shows a reverse scan timing chart according to the first embodiment of the disclosure.

FIG. 4A shows a forward scan timing chart according to the first embodiment of the disclosure. FIG. 4B shows a reverse scan timing chart according to the first embodiment of the disclosure, wherein m is a positive integer smaller than or equal to M. As shown in FIGS. 4A and 4B, in the forward scanning, the forward operation voltage VDD_F has the high level (e.g., VGH), and the reverse operation voltage VDD_R has the low level (e.g., VGL); oppositely in the reverse scanning, the forward operation voltage VDD_F has the low level, and the reverse operation voltage VDD_R has the high level. In addition, the forward clock signal CK1 and the reverse clock signal CK4 have the same phase; the forward clock signal CK2 and the reverse clock signal CK3 have the same phase; the forward clock signal CK3 and the reverse clock signal CK2 have the same phase; and the forward clock signal CK4 and the reverse clock signal CK1 have the same phase.

In the following, the forward scanning (forward shifting) operation according to the first embodiment of the disclosure will be described. In the forward scanning, the operation voltage source VDD_F always has the high level (VGH), and the operation voltage source VDD_R always has the low level (VGL). Taking the first-stage shift register SR1 as an example, in the time slot t1 of FIG. 4A, the start signal STV has the high level (VGH), and the level of the node P is increased from VSS to (VGH−Vth), wherein Vth is a threshold voltage of a thin film transistor, the output signal CF is VGH-2Vth, the output signal CR has the low level (VSS), the output signal OUT is VSS, and the Z node has the low level (VSS). The transistor T1 turns on because the start signal STV received by its gate has the high level (VGH); the transistor T2 turns off because the signal OUT3 received by its gate has the low level (VSS); the transistor T3 turns off because the clock signal CK1 received by its gate has the low level (VSS); the transistor T4 turns on because the signal received by its gate together with the node P have the high level (VGH−Vth); the transistor T5 turns on because the signal received by its gate together with the node P have the high level (VGH−Vth); the transistor T6 turns off because the signal received by its gate together with the node Z have the low level (VSS); the transistor T7 turns off because the clock signal CK3 received by its gate has the low level (VSS); the transistor T8 turns on because the signal received by its gate together with the node P have the high level (VGH−Vth); the transistor T9 turns off because the signal received by its gate together with the node Z have the low level (VSS); the transistor T10 turns off because the clock signal CK3 received by its gate has the low level (VSS); the transistor T11 turns on because the signal received by its gate together with the node P have the high level (VGH−Vth); the transistor T12 turns off because the signal received by its gate together with the node Z have the low level (VSS); the transistor T13 turns off because the clock signal CK3 received by its gate has the low level (VSS); the transistor T14 turns off because the signal received by its gate together with the node Z have the low level (VSS); and the transistor T15 turns off because the clock signal CK3 received by its gate has the low level (VSS).

In the time slot t2 of FIG. 4A, taking the first-stage shift register SR1 as an example, the level of the node P is increased from VSS to $(VGH-Vth+\Delta V_P)$, $\Delta V_P=(VGH-VGL)*C_P/(C_P+C_B)$, wherein $C_P$ is a total parasitic capacitances of the node P, $C_B$ is a boost capacitance. At the time slot t2, the output signal CF is VGH, the output signal CR has the low level (VSS), the output clock signal OUT1 is VGH, and the Z node has the low level (VSS). The transistor T1 turns off because the start signal STV received by its gate has the low level (VSS); the transistor T2 turns off because the clock signal OUT3 received by its gate has the low level (VSS); the transistor T3 turns on because the clock signal CK1 received by its gate has the high level (VGH); the transistor T4 turns on because the signal received by its gate together with the node P have the high level (VGH−Vth+$\Delta V_P$); the transistor T5 turns on because the signal received by its gate together with the node P have the high level (VGH−Vth+$\Delta V_P$); the transistor T6 turns off because the signal received by its gate together with the node Z have the low level (VSS); the transistor T7 turns off because the clock signal CK3 received by its gate has the low level (VSS); the transistor T8 turns on because the signal received by its gate together with the node P have the high level (VGH−Vth$_+\Delta V_P$); the transistor T9 turns off because the signal received by its gate together with the node Z have the low level (VSS); the transistor T10 turns off because the clock signal CK3 received by its gate has the low level (VSS); the transistor T11 turns on because the signal received by its gate together with the node P have the high level (VGH−Vth+ΔVp); the transistor T12 turns off because the signal received by its gate together with the node Z have the low level (VSS); the transistor T13 turns off because the clock signal CK3 received by its gate has the low level (VSS); the transistor T14 turns off because the signal received by its gate together with the node Z have the low level (VSS); and the transistor T15 turns off because the clock signal CK3 received by its gate has the low level (VSS).

Next, taking the first-stage shift register SR1 in the time slot t3 of FIG. 4A as an example, the level of the node P is decreased from (VGH−Vth+ΔVp) to VSS, the output signal CF is VSS, the output signal CR has the low level (VSS), the output clock signal OUT1 is VSS, and the Z node has the low level (VSS). The transistor T1 turns off because the start signal STV received by its gate has the low level (VSS); the transistor T2 turns on because the clock signal OUT3 received by its gate has the high level (VGH); the transistor T3 turns off because the clock signal CK1 received by its gate has the low level (VSS); the transistor T4 turns off because the signal received by its gate together with the node P have the low level (VSS); the transistor T5 turns off because the signal received by its gate together with the node P have the low level (VSS); the transistor T6 turns off because the signal received by its gate together with the node Z have the low level (VSS); the transistor T7 turns on because the clock signal CK3 received by its gate has the high level (VGH); the transistor T8 turns off because the signal received by its gate together with the node P have the low level (VSS); the transistor T9 turns off because the signal received by its gate together with the node Z have the low level (VSS); the transistor T10 turns on because the clock signal CK3 received by its gate has the high level (VGH); the transistor T11 turns off because the signal received by its gate together with the node P have the low level (VSS); the transistor T12 turns off because the signal received by its gate together with the node Z have the low level (VSS); the transistor T13 turns on because the clock signal CK3 received by its gate has the high level (VGH); the transistor T14 turns off because the signal received by its gate together with the node Z have the low level (VSS); and the transistor T15 turns on because the clock signal CK3 received by its gate has the high level (VGH). As mentioned hereinabove, in the forward scanning, except to the first-stage and second-stage shift registers SR1 and SR2 (which receives the start signal STV as their forward scan start signal), the forward scan start signal of the other-stage shift register is the signal CF outputted from its former second-stage shift register.

As mentioned hereinabove, the first embodiment of the disclosure operates normally in the forward scanning.

The operations of the first embodiment of the disclosure in the reverse scanning (reverse shifting) will be described in the following, wherein m=M and m is a positive even number. In the reverse scanning, the operation voltage VDD_F always has the low level (VGL), and the operation voltage VDD_R always has the high level (VGH). The timings of the clock signals CK1 to CK4 have to be changed to those shown in FIG. 4B. That is, the forward clock signal CK1 and the reverse clock signal CK4 have the same phase; the forward clock signal CK2 and the reverse clock signal CK3 have the same phase; the forward clock signal CK3 and the reverse clock signal CK2 have the same phase; and the forward clock signal CK4 and the reverse clock signal CK1 have the same phase.

Taking the last-stage shift register SRM in the time slot t4 of FIG. 4B as an example, the level of the node P is boosted from VSS to (VGH−Vth), the output signal CF is VSS, the output signal CR is VGH-2Vth, the output signal OUT(M) is VSS, and the Z node has the low level (VSS). The transistor T1 turns off because the signal OUT(M−2) received by its gate has the low level (VSS); the transistor T2 turns on because the start signal STV received by its gate has the high level (VGH); the transistor T3 turns off because CK4 received by its gate has the low level (VSS); the transistor T4 turns on because the signal received by its gate together with the node P have the high level (VGH−Vth); the transistor T5 turns on because the signal received by its gate together with the node P have the high level (VGH−Vth); the transistor T6 turns off because the signal received by its gate together with the node Z have the low level (VSS); the transistor T7 turns off because the clock signal CK2 received by its gate has the low level (VSS); the transistor T8 turns on because the signal received by its gate together with the node P have the high level (VGH−Vth); the transistor T9 turns off because the signal received by its gate together with the node Z have the low level (VSS); the transistor T10 turns off because the clock signal CK2 received by its gate has the low level (VSS); the transistor T11 turns on because the signal received by its gate together with the node P have the high level (VGH−Vth); the transistor T12 turns off because the signal received by its gate together with the node Z have the low level (VSS); the transistor T13 turns off because the clock signal CK2 received by its gate has the low level (VSS); the transistor T14 turns off because the signal received by its gate together with the node Z have the low level (VSS); and the transistor T15 turns off because the clock signal CK2 received by its gate has the low level (VSS).

Next, taking the last-stage shift register SRM in the time slot t5 of FIG. 4B as an example, the level of the node P is boosted from (VGH−Vth) to (VGH−Vth+$\Delta V_P$), the output signal OUT(M) has the high level (VGH), and the Z node has the low level (VSS). The transistor T1 turns off because the signal OUT(M−2) received by its gate has the low level (VSS); the transistor T2 turns off because the start signal STV received by its gate has the low level (VSS); the transistor T3 turns on because the clock signal CK4 received by its gate has the high level (VGH); the transistor T4 turns on because the signal received by its gate together with the node P have the high level (VGH−Vth+$\Delta V_P$); the transistor T5 turns on because the signal received by its gate together with the node P have the high level (VGH−Vth+$\Delta V_P$); the transistor T6 turns off because the signal received by its gate together with the node Z have the low level (VSS); the transistor T7 turns off because the clock signal CK2 received by its gate has the low level (VSS); the transistor T8 turns on because the signal received by its gate together with the node P have the high level (VGH−Vth+$\Delta V_P$); the transistor T9 turns off because the signal received by its gate together with the node Z have the low level (VSS); the transistor T10 turns off because the clock signal CK2 received by its gate has the low level (VSS); the transistor T11 turns on because the signal received by its gate together with the node P have the high level (VGH−Vth+$\Delta V_P$); the transistor T12 turns off because the signal received by its gate together with the node Z have the low level (VSS); the transistor T13 turns off because the clock signal CK2 received by its gate has the low level (VSS); the transistor T14 turns off because the signal received by its gate together with the node Z have the low level (VSS); and the transistor T15 turns off because the clock signal CK2 received by its gate has the low level (VSS).

Then, taking the last-stage shift register SRM in the time slot t6 of FIG. 4B as an example, the level of the node P is decreased from (VGH−Vth+$\Delta V_P$) to VSS, the output signal OUT(M) has the low level (VSS), and the Z node has the low level (VSS). The transistor T1 turns on because the signal OUT(M−2) received by its gate has the high level (VGH); the transistor T2 turns off because the start signal STV received by its gate has the low level (VSS); the transistor T3 turns off because the clock signal CK4 received by its gate has the low level (VSS); the transistor T4 turns off because the signal received by its gate together with the node P have the low level (VSS); the transistor T5 turns off because the signal received by its gate together with the node P have the low level (VSS); the transistor T6 turns off because the signal received by its gate together with the node Z have the low level (VSS); the transistor T7 turns on because the clock signal CK2 received by its gate has the high level (VGH); the transistor T8 turns off because the signal received by its gate together with the node P have the low level (VSS); the transistor T9 turns off because the signal received by its gate together with the node Z have the low level (VSS); the transistor T10 turns on because the clock signal CK2 received by its gate has the high level (VGH); the transistor T11 turns off because the signal received by its gate together with the node P have the low level (VSS); the transistor T12 turns off because the signal received by its gate together with the node Z have the low level (VSS); the transistor T13 turns on because the clock signal CK2 received by its gate has the high level (VGH); the transistor T14 turns off because the signal received by its gate together with the node Z have the low level (VSS); and the transistor T15 turns on because the clock signal CK2 received by its gate has the high level (VGH). As mentioned hereinabove, in the reverse scanning, except to the $(M-1)^{th}$-stage and $M^{th}$-stage shift registers SRM−1 and SRM (which receive the start signal STV as their reversal scan start signal), the reverse scan start signal of the other-stage shift register is the signal CR of its next second-stage shift register.

As mentioned hereinabove, the first embodiment of the disclosure operates normally in the reverse scanning.

Because the TFT is an imperfect switch element, when the switch element turns off, there is still the leakage current flowing through its drain and its source. When the drain-source voltage Vds gets higher, the leakage current gets larger, and the leakage current becomes higher at the high temperature, so that the circuit operation has abnormal risks. For example, the leakage current may cause the output signal OUT of the shift register to have multiple peaks, so that its corresponding scan line is turned on multiple times in one frame period. Thus, in the first embodiment of the disclosure, the node P suppresses current leakage path in order to keep the circuit stability. As mentioned hereinabove, the source of the transistor T5 of the current-stage shift register is connected to the drain of the transistor T1 of the next second-stage shift register; and the source of the transistor T8 of the current-stage shift register is connected to the source of the transistor T2 of the former second-stage shift register. In the forward shifting, when the drain-source cross voltage Vds of the transistor T5 of the current-stage shift register is kept at VGH−VSS for a long time, the transistor T5 has the leakage current Ioff1, so that the potential of its output signal CF is increased slowly. Through the blocking of the transistor T1 of the next second-stage shift register, the leakage current Ioff2 into the node P of the next second-stage shift register becomes smaller. Because the node P controls the operation of the transistor T11 to output the scan signal to the display area, the potential of the node P is kept stable to maintain the stabilities of the shift register and the overall circuit. Similarly, in the reverse shifting, the transistor T8 of the current-stage shift register has the leakage current Ioff3, so that the output signal CR is increased slowly. Through the blocking of the transistor T2 of the former second-stage shift register, the leakage current Ioff4 into the former second-stage shift register becomes smaller, thereby keeping the potential of the node P stable to maintain the stabilities of the shift register and the overall circuit.

Second Embodiment

Figure 5:
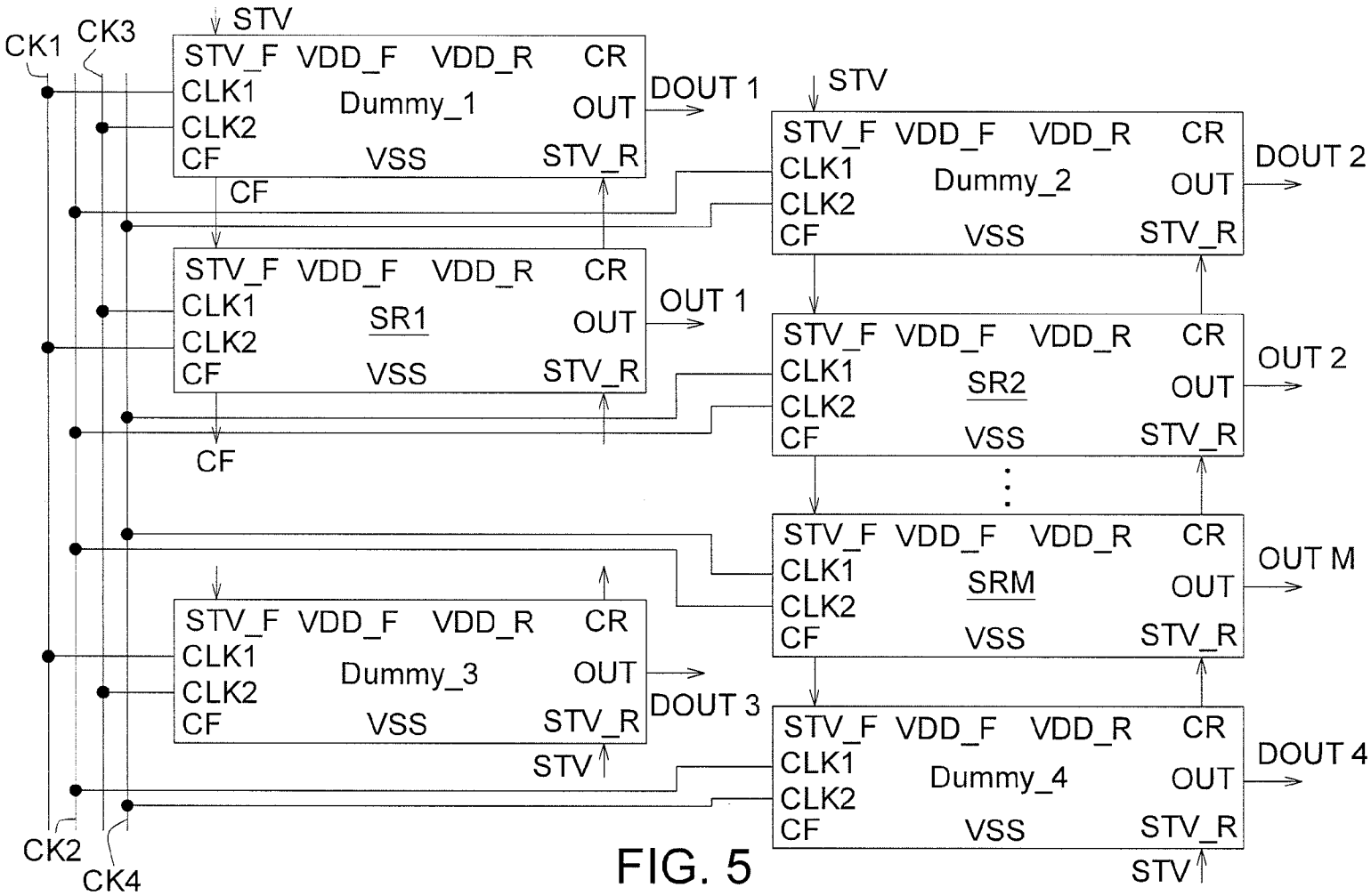
FIG. 5 is a circuit architecture diagram showing a GOP driving circuit according to a second embodiment of the disclosure.

In the second embodiment of the disclosure, the GOP driving circuit further includes multiple dummy shift registers. FIG. 5 is a circuit architecture diagram showing a GOP driving circuit according to a second embodiment of the disclosure. Referring to FIG. 5, the GOP driving circuit further includes four dummy shift registers Dummy_1 to Dummy_4. The dummy shift register Dummy_1 and the dummy shift register Dummy_2, disposed in front of the first second-stage shift registers, drop down the output signals OUT of the first second-stage shift registers in the reverse scanning; and the dummy shift register Dummy_3 and the dummy shift register Dummy_4, disposed in back of the last two stages of shift registers, drop down the output signals OUT of the last two stages of shift registers in the forward scanning. The addition of the dummy shift registers Dummy_1 to Dummy_4 may drop down the bias voltages applied to all TFT elements of the shift registers SR1~SRM after scanning, thereby preventing the deterioration of the gating function of the TFT element caused by the voltage bias stress.

Figure 6A:
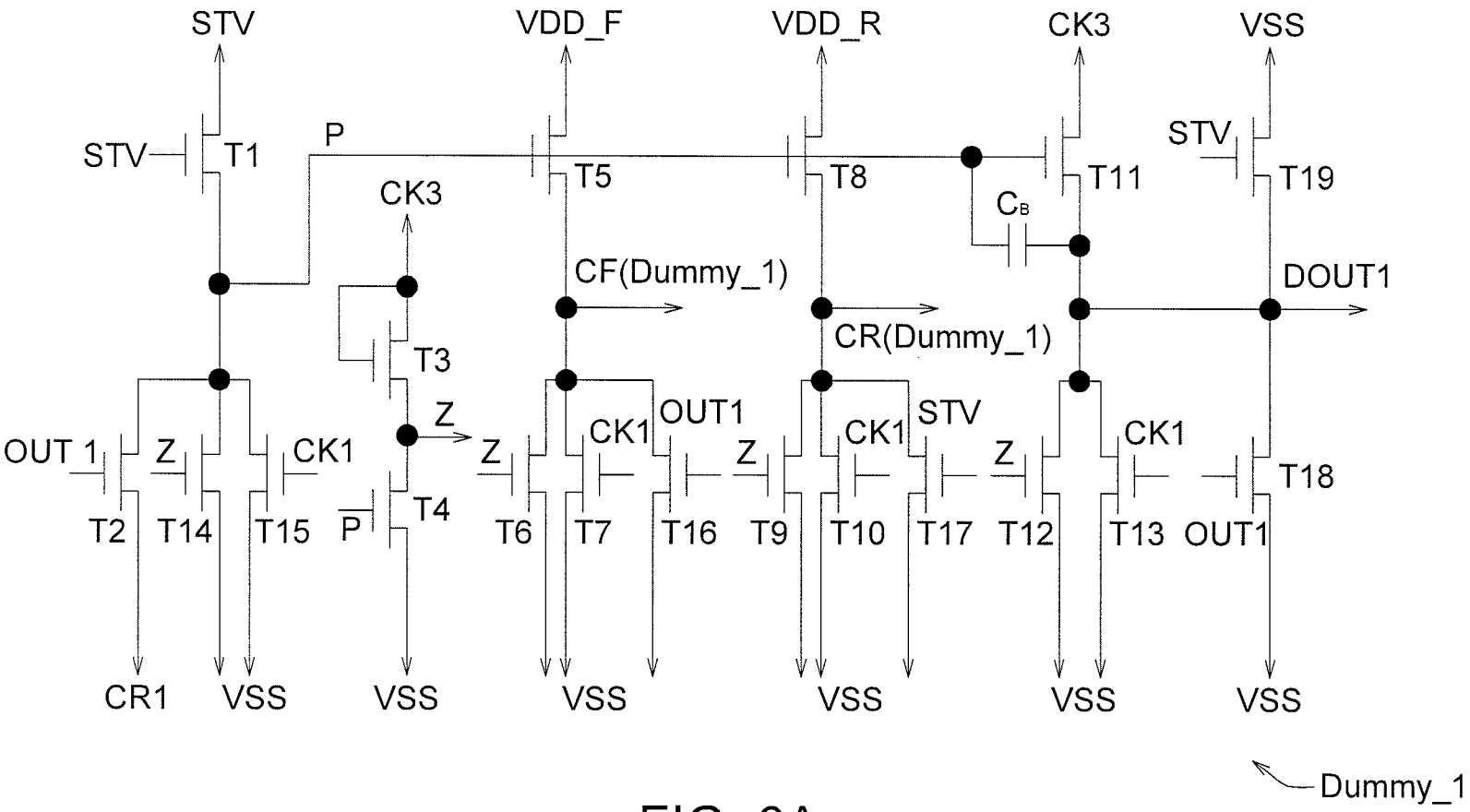
FIG. 6A is a circuit architecture diagram showing a shift register according to the second embodiment of the disclosure.

FIG. 6A is a circuit architecture diagram showing a shift register according to the second embodiment of the disclosure. Herein, the dummy shift register Dummy_1 serves as an example. Basically, each shift register and each dummy shift register have the same circuit architecture, and the difference therebetween resides in coupling of the input and output signals. In the second embodiment, the shift register includes transistors T1 to T19. As shown in FIG. 6, taking the dummy shift register Dummy_1 as an example, the gate of the transistor T16 is connected to the output signal OUT1 of the next second-stage shift register SR1, the drain thereof is connected to the output signal CF (Dummy_1), and the source thereof is connected to the ground VSS. The gate of the transistor T17 is connected to the start signal STV, the drain thereof is connected to the output signal CR(Dummy_1), and the source thereof is connected to the ground VSS. The gate of the transistor T18 is connected to the output signal OUT1 of the next second-stage shift register SR1, the source thereof is connected to the ground VSS, and the drain thereof outputs the signal DOUT1. The gate of the transistor T19 is connected to the start signal STV, the drain thereof outputs the signal DOUT1, and the source thereof is connected to the ground VSS. In addition, in the second embodiment, the gate and drain of the transistor T1 of the shift register SR1 respectively receive the signal DOUT1 and the signal CF from the dummy shift register Dummy_1, as the forward scan start signal of the shift register SR1; the gate and drain of the transistor T1 of the shift register SR2 respectively receive the signals DOUT2 and CF from the dummy shift register Dummy_2, as the forward scan start signal of the shift register SR2; the gate and source of the transistor T2 of the $(M-1)^{th}$-stage shift register SR(M−1) (not shown) respectively receive the signals DOUT3 and CR from the dummy shift register Dummy_3, as the reverse scan start signal of the $(M-1)^{th}$-stage shift register SR(M−1); the gate and source of the transistor T2 of the $M^{th}$-stage shift register SRM respectively receive the signals DOUT4 and CR from the dummy shift register Dummy_4, as the reverse scan start signal of the $M^{th}$-stage shift register SRM.

The forward scanning (forward shifting) operation of the second embodiment of the disclosure will be described in the following with reference to FIG. 6B. The turn on/off of the transistors T1 to T15 are the same as those of the first embodiment, so only the turn on/off of the transistors T16 to T19 will be described in the following. Taking the dummy shift register Dummy_1 as an example, in the time slot t7 of FIG. 6B, the transistor T16 turns off because the output signal OUT1 received by its gate has the low level (VSS); the transistor T17 turns on because the start signal STV received by its gate has the high level (VGH); the transistor T18 turns off because the output signal OUT1 received by its gate has the low level (VSS); and the transistor T19 turns on because the start signal STV received by its gate has the high level (VGH).

Figure 6B:
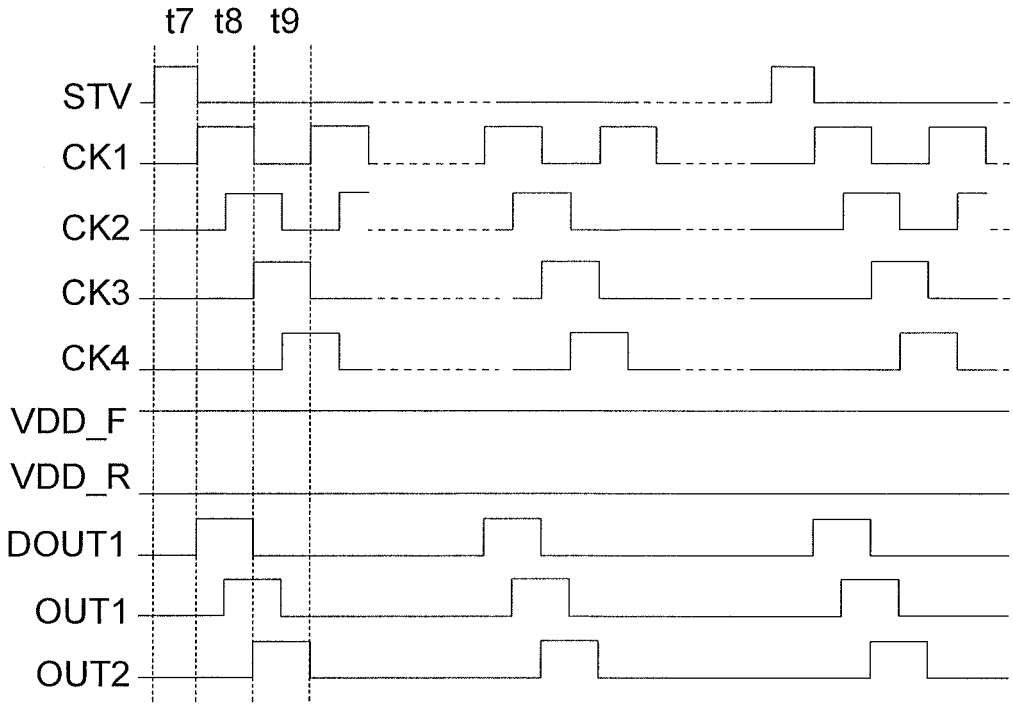
FIG. 6B shows a forward scan timing chart according to the second embodiment of the disclosure.

Next, taking the dummy shift register Dummy_1 in the time slot t8 of FIG. 6B as an example, the transistor T16 turns off because the output signal OUT1 received by its gate has the low level (VSS); the transistor T17 turns off because the start signal STV received by its gate has the low level (VSS); the transistor T18 turns off because the output signal OUT1 received by its gate has the low level (VSS); and the transistor T19 turns off because the start signal STV received by its gate has the low level (VSS).

Next, taking the dummy shift register Dummy_1 in the time slot t9 of FIG. 6B as an example, the transistor T16 turns on because the output signal OUT1 received by its gate has the high level (VGH); the transistor T17 turns off because the start signal STV received by its gate has the low level (VSS); the transistor T18 turns on because the output signal OUT1 received by its gate has the high level (VGH); and the transistor T19 turns off because the start signal STV received by its gate has the low level (VSS).

In addition, the output signal DOUT3 of the dummy shift register Dummy_3 is inputted to the gate of the transistor T18 of the $(M-1)^{th}$-stage shift register SR(M−1). In the forward scanning, when the output signal DOUT3 of the dummy shift register Dummy_3 has the high level (VGH), the transistor T18 of the $(M-1)^{th}$-stage shift register SR(M−1) turns on to drop down the output signal OUT(M−1) of the $(M-1)^{th}$-stage shift register SR(M−1). Similarly, the output signal DOUT4 of the dummy shift register Dummy_4 is inputted to the gate of the transistor T18 of the $M^{th}$-stage shift register SRM. In the forward scanning, when the output signal DOUT4 of the dummy shift register Dummy_4 has the high level (VGH), the transistor T18 of the $M^{th}$-stage shift register SRM turns on to drop down the output signal OUTM of the $M^{th}$-stage shift register SRM.

As mentioned hereinabove, the second embodiment of the disclosure operates normally in the forward scanning.

The operations in the reverse scanning (reverse shifting) according to the second embodiment of the disclosure will be described in the following. Taking the dummy shift register Dummy_4 in the time slot t10 of FIG. 6C as an example, the transistor T16 turns on because the start signal STV received by its gate has the high level (VGH); the transistor T17 turns off because the signal CF outputted from the $M^{th}$-stage shift register SRM and received by its gate has the low level (VSS); the transistor T18 turns on because the start signal STV received by its gate has the high level (VGH); and the transistor T19 turns off because the signal CF outputted from the $M^{th}$-stage shift register SRM and received by its gate has the low level (VSS).

Figure 6C:
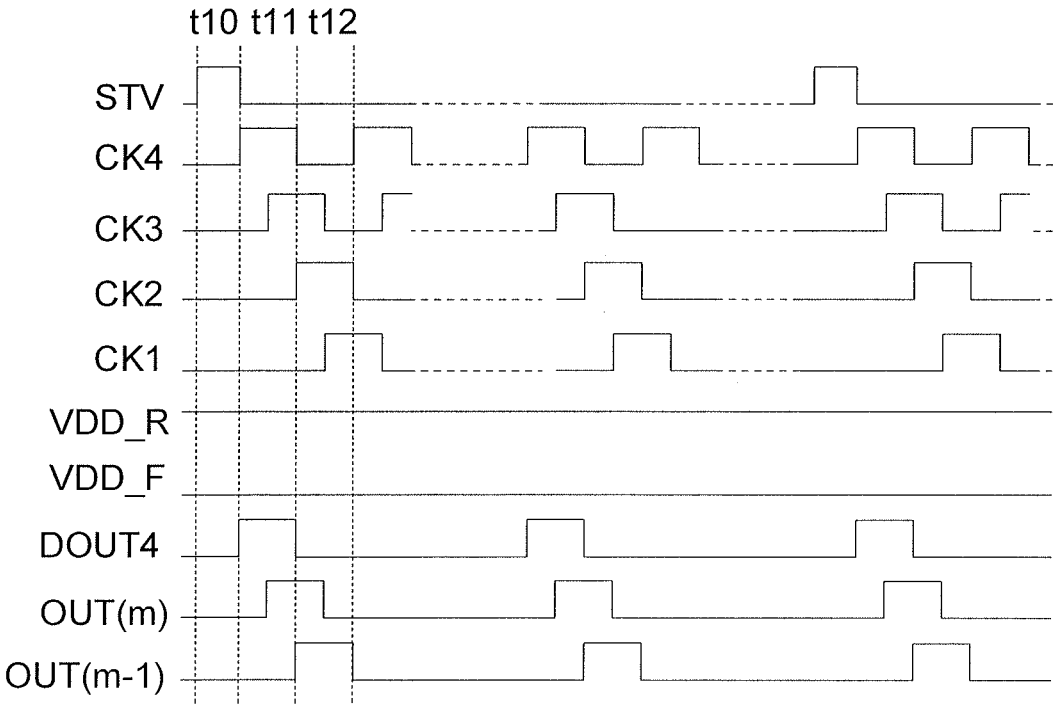
FIG. 6C shows a reverse scan timing chart according to the second embodiment of the disclosure.

Next, taking the dummy shift register Dummy_4 in the time slot t11 of FIG. 6C as an example, the transistor T16 turns off because the start signal STV received by its gate has the low level (VSS); the transistor T17 turns off because the signal CF outputted from the $M^{th}$-stage shift register SRM and received by its gate has the low level (VSS); the transistor T18 turns off because the start signal STV received by its gate has the low level (VSS); and the transistor T19 turns off because the signal CF outputted from the $M^{th}$-stage shift register SRM and received by its gate has the low level (VSS).

Then, taking the dummy shift register Dummy_4 in the time slot t12 of FIG. 6C as an example, the transistor T16 turns off because the start signal STV received by its gate has the low level (VSS); the transistor T17 turns on because the signal CF outputted from the $M^{th}$-stage shift register SRM and received by its gate has the high level (VGH); the transistor T18 turns off because the start signal STV received by its gate has the low level (VSS); and the transistor T19 turns on because the signal CF outputted from the $M^{th}$-stage shift register SRM and received by its gate has the high level (VGH).

In addition, the output signal CF of the dummy shift register Dummy_1 is inputted to the gate of the transistor T19 of the first-stage shift register SR1. In the reverse scanning, when the output signal CF of the dummy shift register Dummy_1 has the high level (VGH), the transistor T19 of the first-stage shift register SR1 turns on to drop down the output signal OUT1 of the first-stage shift register SR1. Similarly, the output signal CF of the dummy shift register Dummy_2 is inputted to the gate of the transistor T19 of the second-stage shift register SR2. In the reverse scanning, when the output signal CF of the dummy shift register Dummy_2 has the high level (VGH), the transistor T19 of the second-stage shift register SR2 turns on to drop down the output signal OUT2 of the second-stage shift register SR2.

According to the above-mentioned description, the second embodiment of the disclosure operates normally in the reverse scanning.

Similarly, in the second embodiment of the disclosure, the transistors T1, T2, T5 and T8 may suppress the leakage current into the node P to keep the normal operation of the circuit.

The reason of increasing the dummy shift registers is to enhance the circuit stability. Because the transistors T6, T7, T9, T10, T12, T13, T14 and T15 may be aged due to the stress, the transistors T16 to T19 may enhance the life cycle and the operation stability of the shift register.

Third Embodiment

Figure 7:
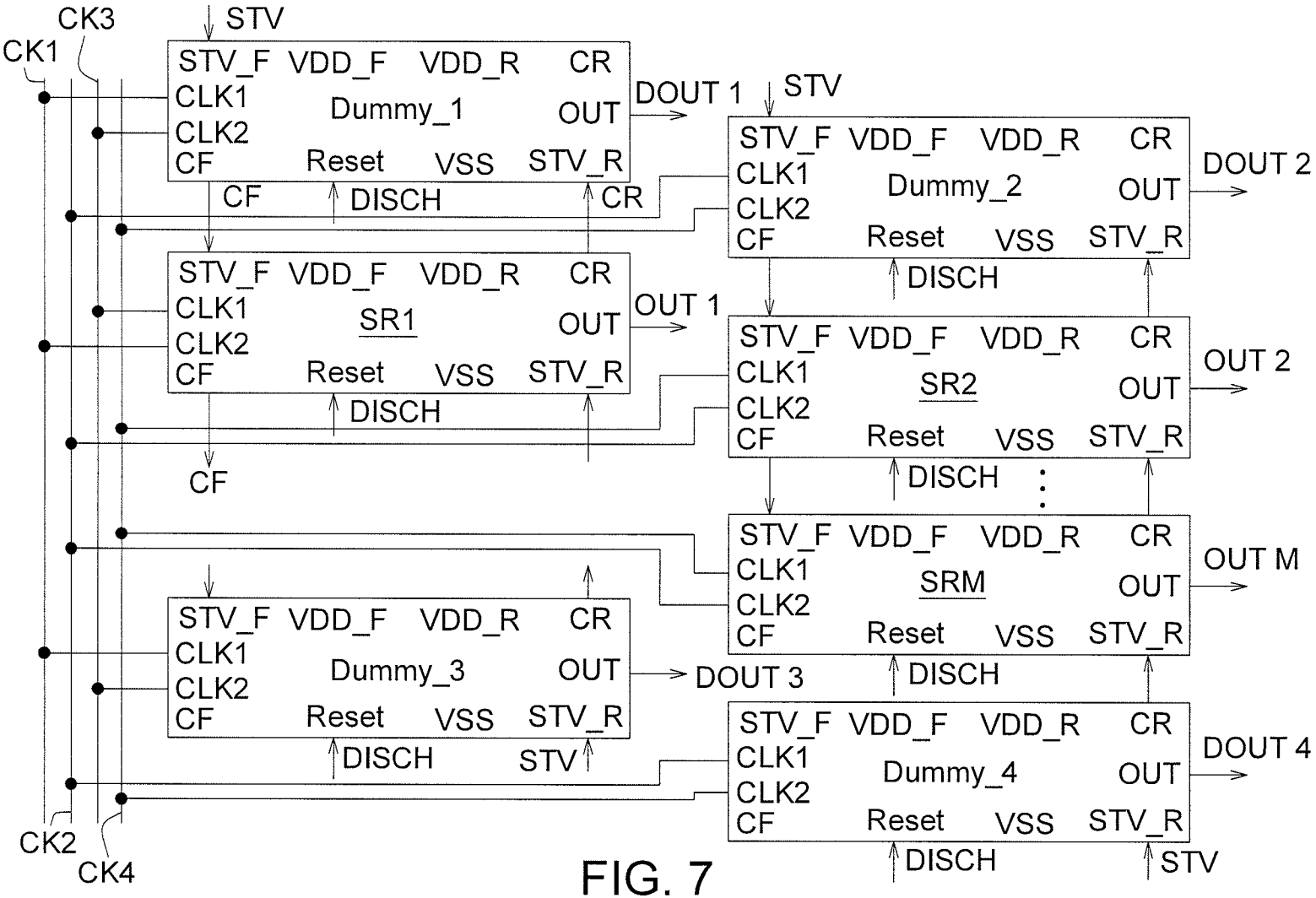
FIG. 7 is a circuit architecture diagram showing a GOP driving circuit according to a third embodiment of the disclosure.

FIG. 7 is a circuit architecture diagram showing a GOP driving circuit according to a third embodiment of the disclosure. In the third embodiment of the disclosure, a discharge signal DISCH is asserted in the blanking time to drop down the nodes P, the signals CF, the signals CR and the output signals DOUT of the dummy shift registers Dummy_1 to Dummy_4 to further ensure the operation stability of the circuit. In addition, applying the discharge signal DISCH to the shift registers SR1 to SRM is advantageous to the eliminating of the residual images. Because in shutdown, the nodes P, the signal CF, the signal CR and the output signal OUT of the shift registers SR1 to SRM are firstly boosted, and then are dropped down by the discharge signal DISCH, to solve the residual images. Nevertheless, applying the discharge signal DISCH to the shift registers SR1 to SRM is optional.

Figure 8A:
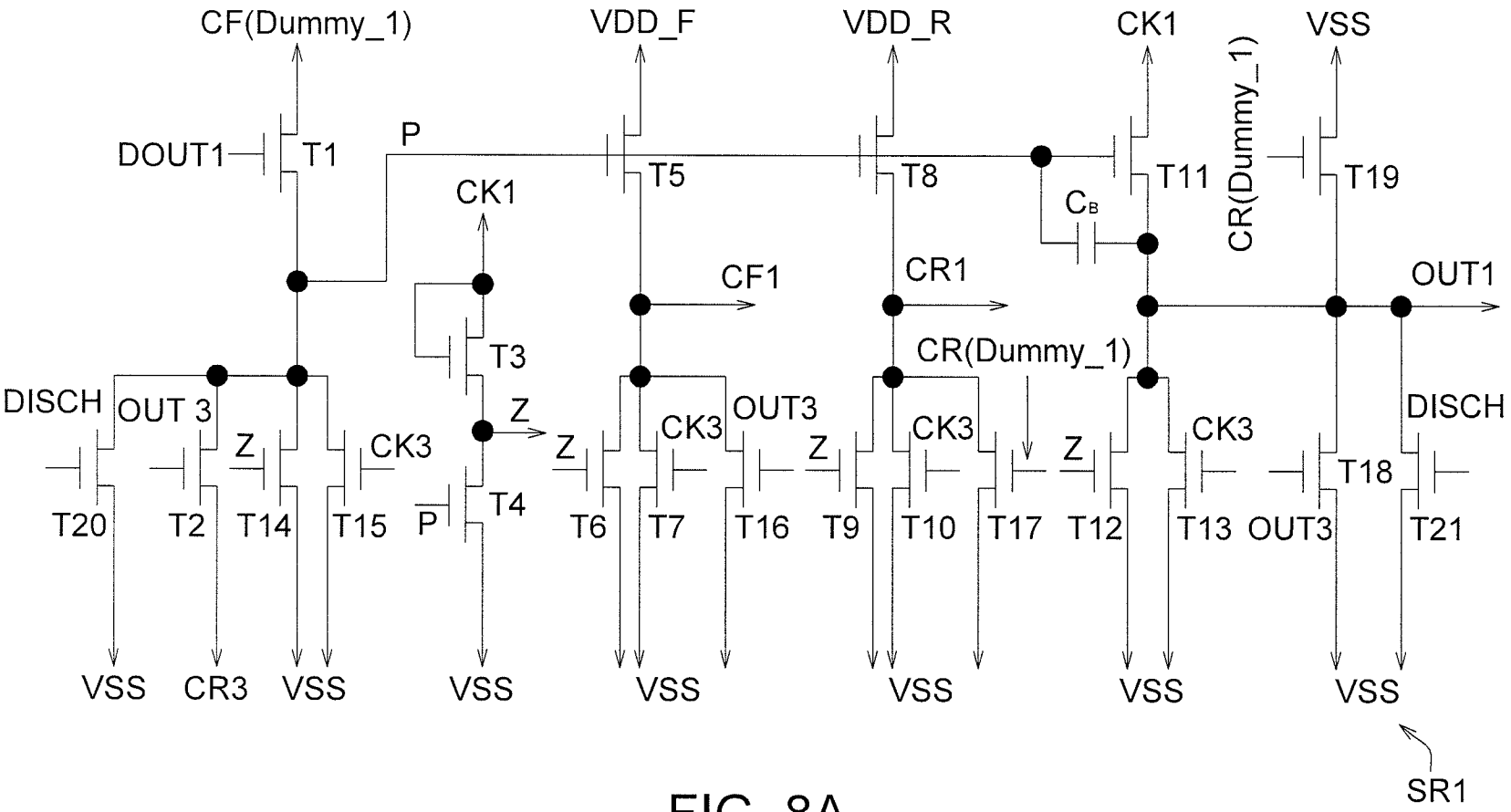
FIG. 8A is a circuit architecture diagram showing a shift register according to the third embodiment of the disclosure.

FIG. 8A is a circuit architecture diagram showing a shift register according to the third embodiment of the disclosure. In the third embodiment, each shift register includes transistors T1 to T21. Basically, the shift registers have the same circuit architecture. The drain, gate and source of the transistor T20 are respectively connected to the node P and the discharge signals DISCH and VSS to drop the node P; and the drain, gate and source of the transistor T21 are respectively connected to the output signal OUT, and the discharge signals DISCH and VSS, to drop down the output signal OUT. The architecture of the $M^{th}$-stage shift register SRM of the third embodiment may be derived from FIG. 8A and the first and second embodiments. For example, the connections of the transistors T20 and T21 of the $M^{th}$-stage shift register SRM are the same as those of T20 and T21 of FIG. 8A. The drain of the transistor T2 of the $M^{th}$-stage shift register SRM is connected to the node P, the gate thereof is connected to the output signal DOUT4 of the next second-stage dummy shift register Dummy_4, and the source thereof is connected to the output signal CR of the next second-stage dummy shift register Dummy_4.

Figure 8B:
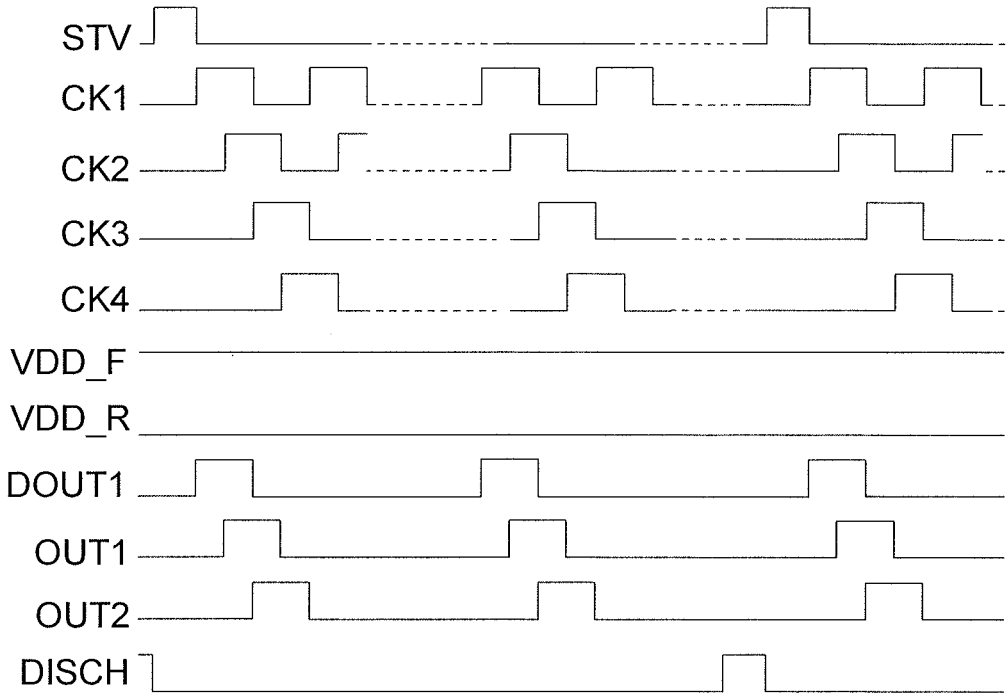
FIG. 8B shows a forward scan timing chart according to the third embodiment of the disclosure.
Figure 8C:
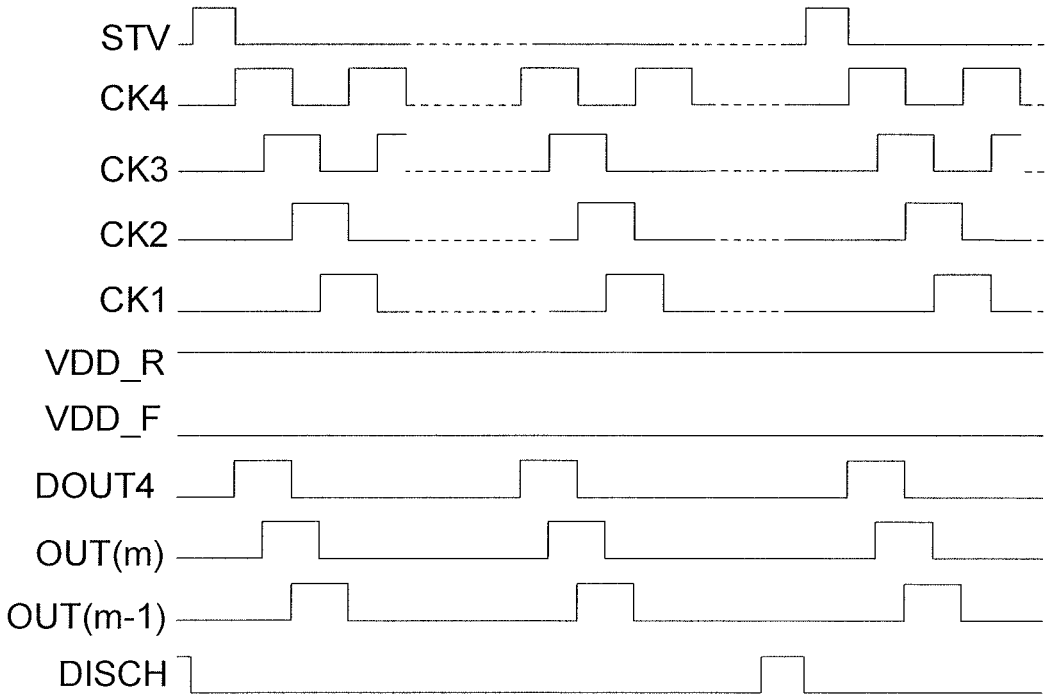
FIG. 8C shows a reverse scan timing chart according to the third embodiment of the disclosure.

FIG. 8B shows a forward scan timing chart according to the third embodiment of the disclosure. FIG. 8C shows a reverse scan timing chart according to the third embodiment of the disclosure. The discharge signal DISCH is asserted in the blanking time for the discharge operation.

Figure 8D:
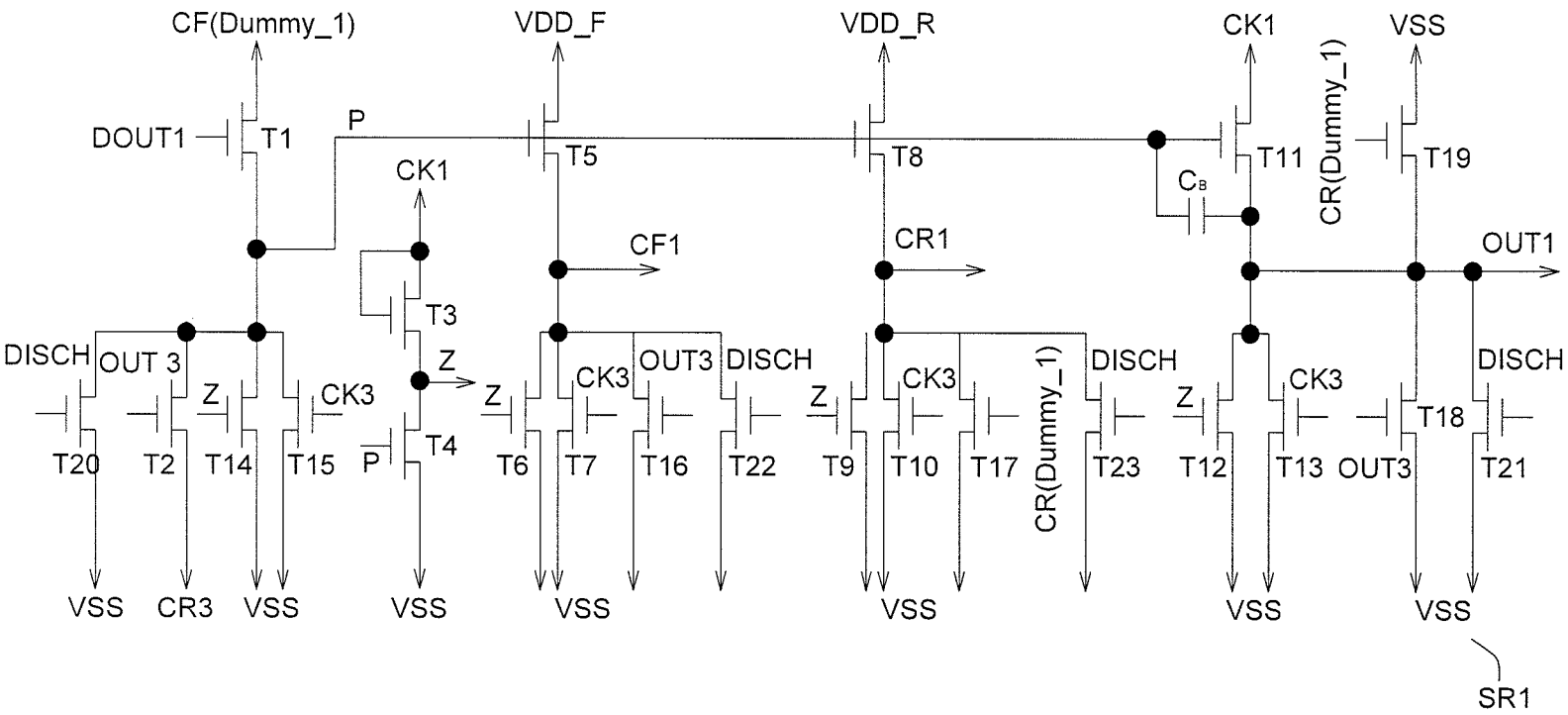
FIG. 8D is another circuit architecture diagram showing the shift register according to the third embodiment of the disclosure.

FIG. 8D is a circuit architecture diagram showing another shift register according to the third embodiment of the disclosure. In FIG. 8D, the shift register further includes a transistor T22 having a gate, a drain and a source respectively connected to the discharge signals DISCH, and the signal CF and VSS, to drop down the signal CF. The shift register in FIG. 8D further includes a transistor T23 having a gate, a drain and a source respectively connected to the discharge signal DISCH, and the signal CR and VSS to drop down the signal CR.

Fourth Embodiment

Figure 9:
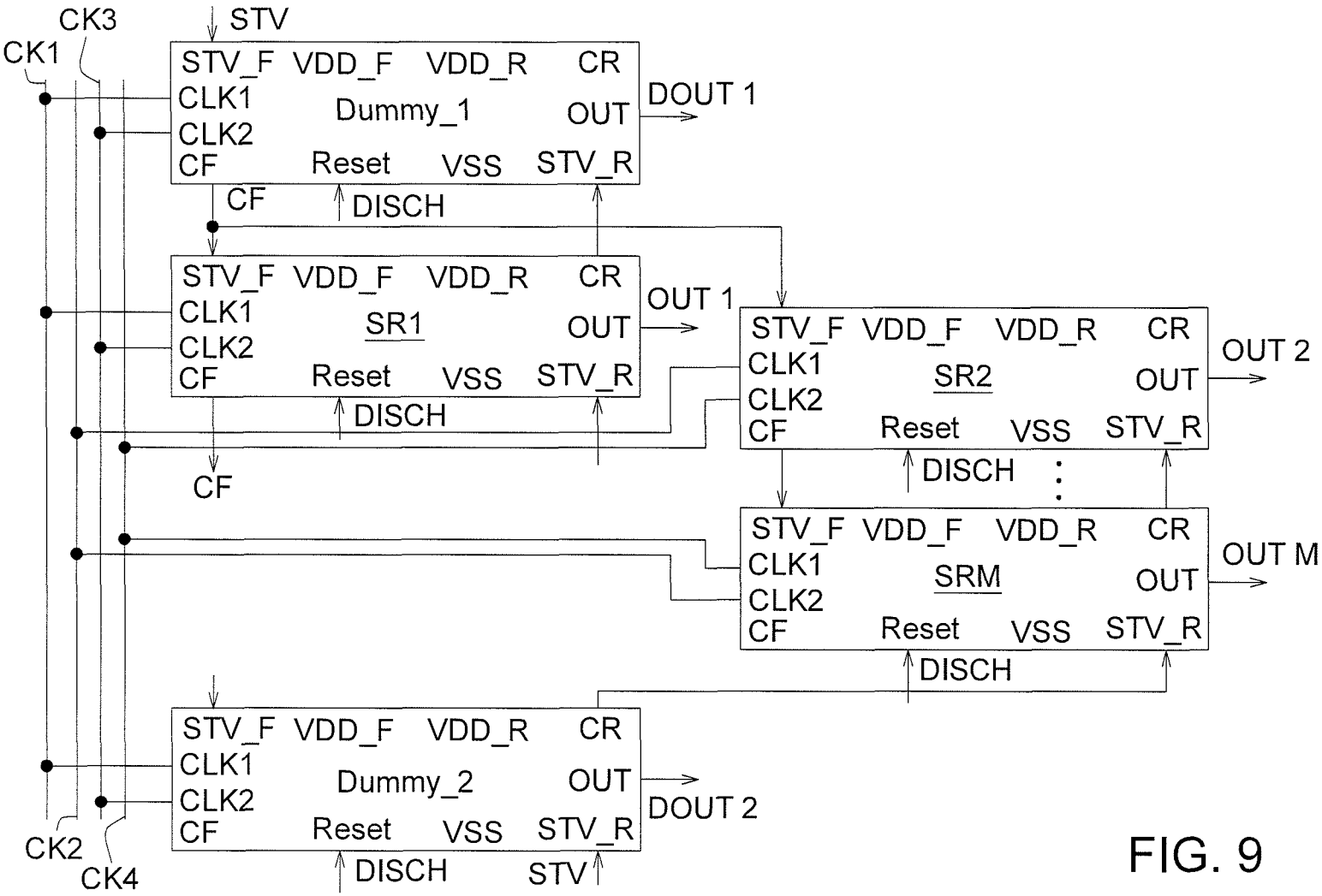
FIG. 9 is a schematic illustration showing a GOP driving circuit according to a fourth embodiment of the disclosure.

FIG. 9 is a schematic illustration showing a GOP driving circuit according to a fourth embodiment of the disclosure. The difference between the fourth embodiment and the second to the third embodiments is that dummy shift registers Dummy_1 and Dummy_2 are added to the front and the back of the shift registers SR1~SRM. The signal CF of the dummy shift register Dummy_1 serves as the forward start signal of the shift registers SR1 and SR2; and the signal CR of the dummy shift register Dummy_2 serves as the reverse start signal of the last two stages of shift registers SRM and SR(M−1). In principle, the architectures and operations of the shift registers or the dummy shift registers of the fourth embodiment may be the same as or similar to that of the first to third embodiments, so detailed descriptions thereof will be omitted.

Figure 10A:
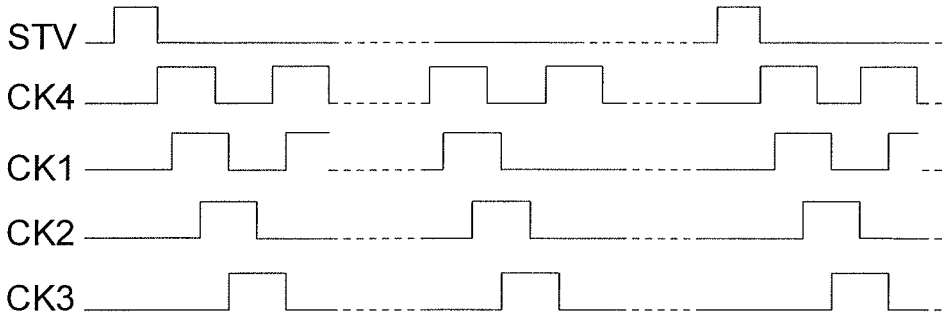
FIGS. 10A and 10B respectively show a forward scan timing chart and a reverse scan timing chart according to the fourth embodiment of the disclosure.
Figure 10B:
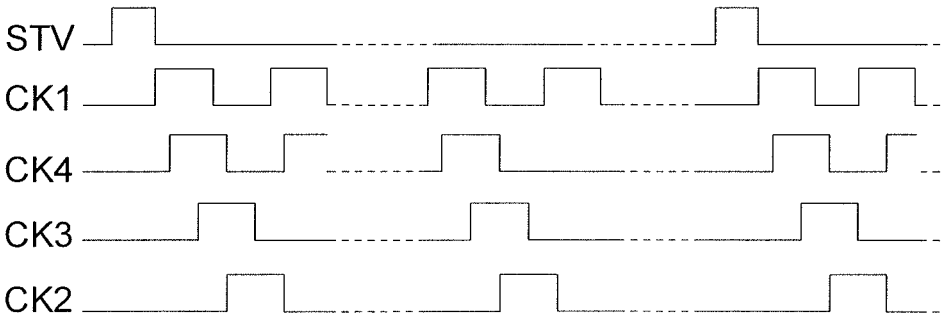

FIGS. 10A and 10B respectively show a forward scan timing chart and a reverse scan timing chart according to the fourth embodiment of the disclosure.

Fifth Embodiment

Figure 11:
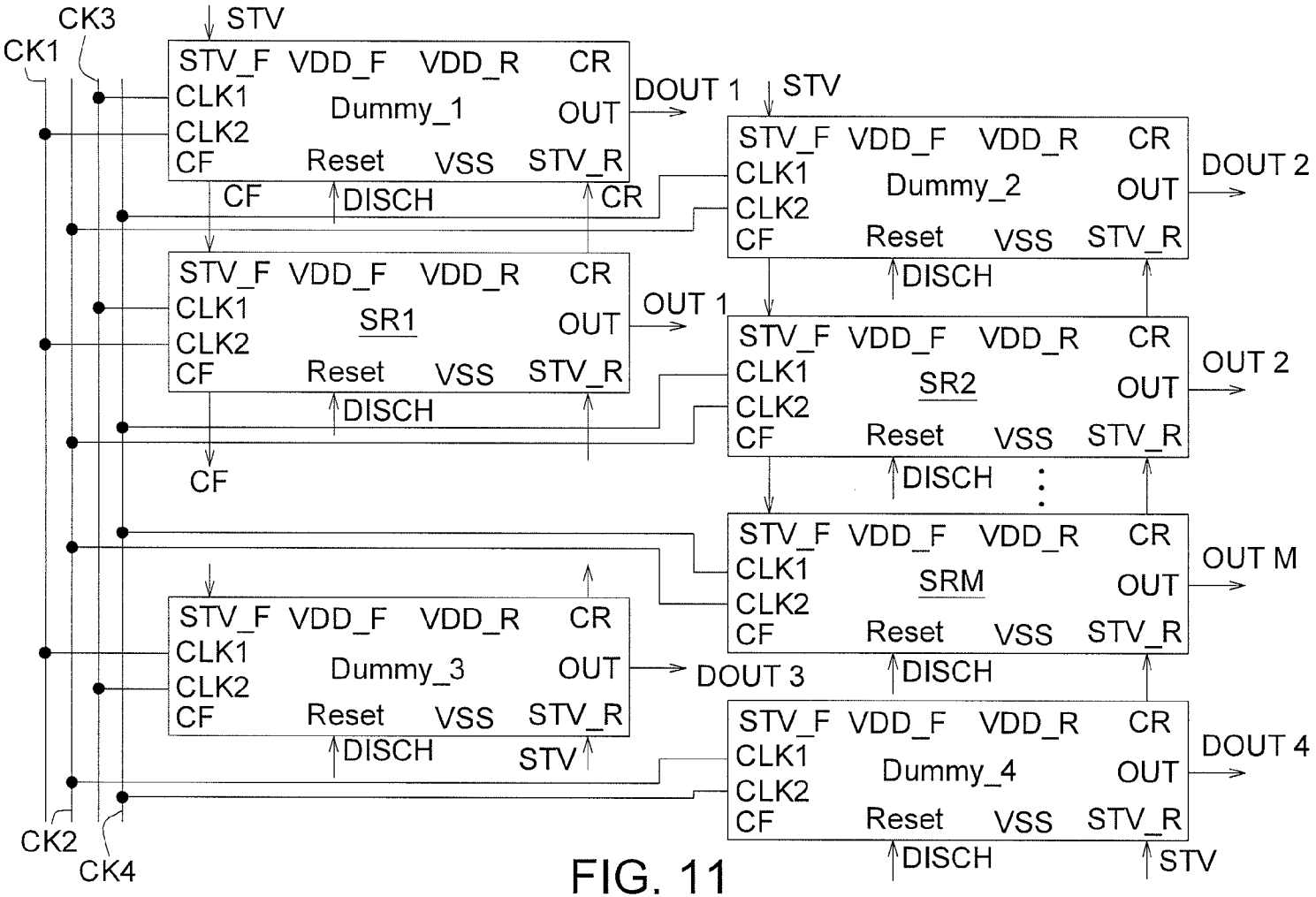
FIG. 11 is a schematic illustration showing a GOP driving circuit according to a fifth embodiment of the disclosure.

FIG. 11 is a schematic illustration showing a GOP driving circuit according to a fifth embodiment of the disclosure. The difference between the fifth embodiment and the second to the third embodiments resides in that the shift register of the fifth embodiment receives the clock signals CK1 to CK4 in a different manner. In principle, the architectures and operations of the shift registers or the dummy shift registers of the fifth embodiment may be the same as or similar to that of the first to the third embodiments, so detailed descriptions thereof will be omitted.

Figure 12A:
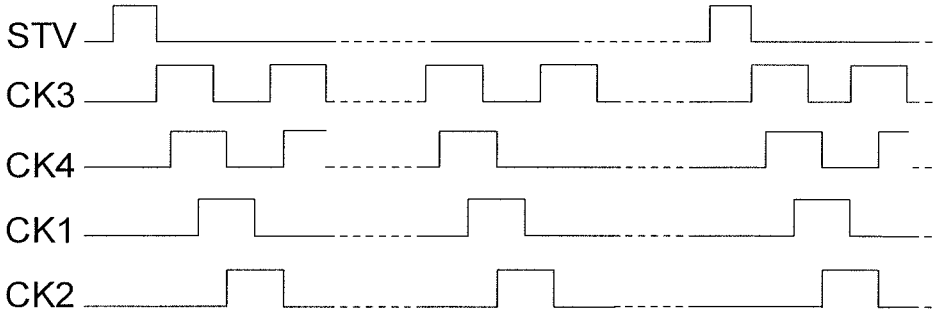
FIGS. 12A and 12B respectively show a forward scan timing chart and a reverse scan timing chart according to the fifth embodiment of the disclosure.
Figure 12B:
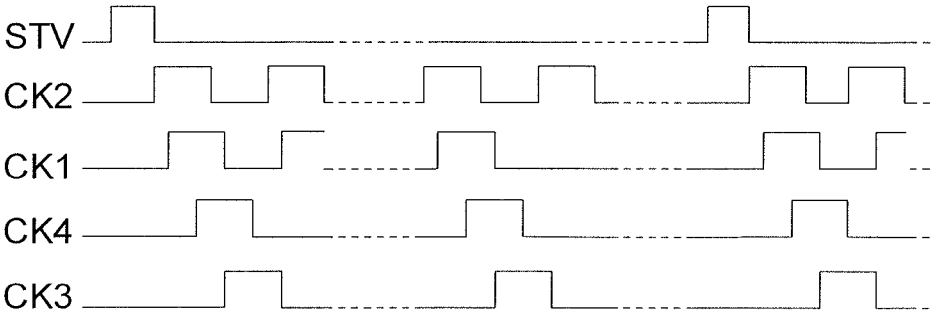

FIGS. 12A and 12B respectively show a forward scan timing chart and a reverse scan timing chart according to the fifth embodiment of the disclosure. As shown in FIG. 12A, in the forward scanning (shifting), the clock signals CK3, CK4, CK1 and CK2 are sequentially transited to logic high. As shown in FIG. 12B, in the reverse scanning (shifting), the clock signals CK2, CK1, CK4 and CK3 are sequentially transited to logic high.

Sixth Embodiment

Figure 13:
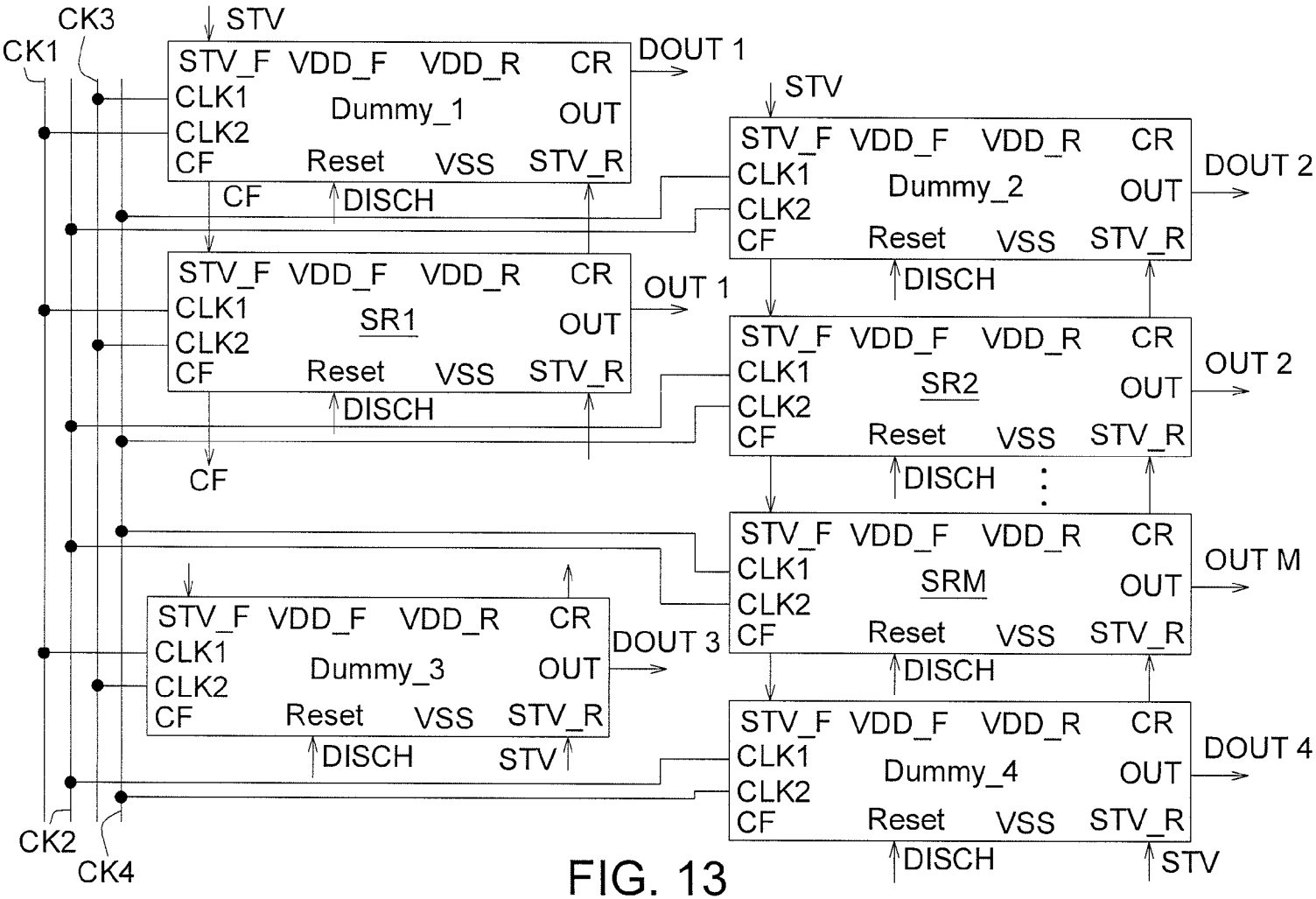
FIG. 13 is a schematic illustration showing a GOP driving circuit according to a sixth embodiment of the disclosure.

FIG. 13 is a schematic illustration showing a GOP driving circuit according to a sixth embodiment of the disclosure. The difference between the sixth embodiment and the second to the third embodiments resides in that the shift register of the sixth embodiment receives the clock signals CK1 to CK4 in a different manner. In principle, the architectures and operations of the shift registers or the dummy shift registers of the sixth embodiment may be the same as or similar to that of the first to the third embodiments, so detailed descriptions thereof will be omitted.

Figure 14A:
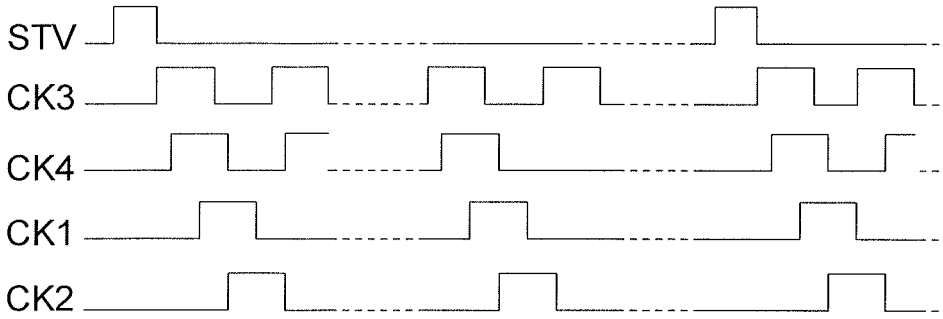
FIGS. 14A and 14B respectively show a forward scan timing chart and a reverse scan timing chart according to the sixth embodiment of the disclosure.
Figure 14B:
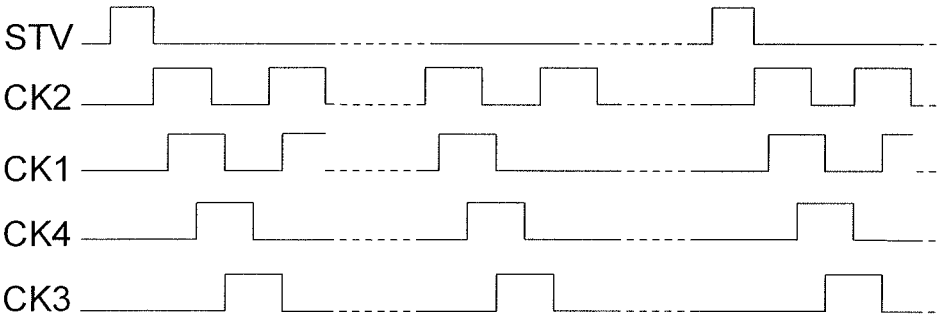

FIGS. 14A and 14B respectively show a forward scan timing chart and a reverse scan timing chart according to the sixth embodiment of the disclosure. As shown in FIG. 14A, in the forward scanning (shifting), the clock signals CK3, CK4, CK1 and CK2 are sequentially transited to logic high. As shown in FIG. 14B, in the reverse scanning (shifting), the clock signals CK2, CK1, CK4 and CK3 are sequentially transited to logic high In addition, in the above-mentioned embodiments of the disclosure, the transistors T1, T2 and T16 to T21 are turned on once within one frame display time. So, if other transistors of the same stage shift register are applied by the stress voltage bias for a long time, their threshold voltage may rise so that they may lose the switch function. In this condition, in the embodiments of the disclosure, the circuit operation still may be kept through the operations of the transistors T1, T2, T16 and T21.

It will be appreciated by those skilled in the art that changes could be made to the disclosed embodiments described above without departing from the broad inventive concept thereof. It is understood, therefore, that the disclosed embodiments are not limited to the particular examples disclosed, but is intended to cover modifications within the spirit and scope of the disclosed embodiments as defined by the claims that follow.

What is claimed is:

1. A display driving circuit formed on a thin film transistor array substrate, the display driving circuit comprising:

a plurality of shift registers, odd-stage shift registers thereof cascaded and even-stage shift registers thereof cascaded, the shift registers supporting dual direction shifting, each of the shift registers comprising:

a first transistor, a second transistor, a third transistor and a fourth transistor, wherein the first transistor is coupled to a forward scan start signal outputted from a third transistor of a former second-stage shift register, coupled to an output signal of the former second-stage shift register, and coupled to a node; the second transistor is coupled to a reverse scan start signal outputted from a fourth transistor of a next second-stage shift register, coupled to an output signal outputted from the next second-stage shift register, and coupled to the node; the third transistor is coupled to a forward operation voltage and the node, and outputs a forward scan start signal; and the fourth transistor is coupled to a reverse operation voltage and the node, and outputs a reverse scan start signal.

2. The display driving circuit according to claim 1, wherein in forward scanning, the shift register is initiated by the forward scan start signal of the former second-stage shift register, the forward operation voltage is a first reference voltage, and the reverse operation voltage is a second reference voltage.

3. The display driving circuit according to claim 2, wherein in reverse scanning, the shift register is initiated by the reverse scan start signal of the next second-stage shift register, the forward operation voltage is the second reference voltage, and the reverse operation voltage is the first reference voltage.

4. The display driving circuit according to claim 1, wherein the first transistor of a first-stage shift register of the shift registers has a first end and a second end coupled to a start signal outputted from a timing controller; and a third end coupled to the node.

5. The display driving circuit according to claim 1, further comprising:

one or more first dummy shift registers, disposed in front of first two-stage shift registers of the shift registers, for dropping down the output signals of the first two-stage shift registers; and one or more second dummy shift registers, disposed in back of last two-stage shift registers of the shift registers, for dropping down the output signals of the last two-stage shift registers.

6. The display driving circuit according to claim 5, wherein each of the shift registers further comprises:

a fifth transistor to an eighth transistor, wherein the fifth transistor is coupled to the forward scan start signal outputted from the third transistor and coupled to the output signal outputted from the next second-stage shift register; the sixth transistor is coupled to the reverse scan start signal outputted from the fourth transistor and coupled to a start signal outputted from a timing controller; the seventh transistor is coupled to the output signal outputted from the next second-stage shift register and coupled to the output signal; and the eighth transistor is coupled to the start signal and the output signal.

7. The display driving circuit according to claim 6, wherein each of the shift registers further comprises:

a ninth transistor and a tenth transistor, wherein the ninth transistor is coupled to a discharge signal and the node, the tenth transistor is coupled to the discharge signal and the output signal, wherein the discharge signal drops down a plurality of output signals and internal signals of the dummy shift registers in a blanking period.

8. The display driving circuit according to claim 7, wherein the discharge signal further drops down the output signals and the internal signals of the shift registers in the blanking period.

9. A display panel, comprising:

a thin film transistor array substrate;

a plurality of scan lines formed on the thin film transistor array substrate; and a driving circuit, formed on the thin film transistor array substrate, for driving the scan lines, the display driving circuit comprising:

a plurality of shift registers, odd-stage shift registers thereof cascaded and even-stage shift registers thereof cascaded, the shift registers supporting dual direction shifting, each of the shift registers comprising: a first transistor, a second transistor, a third transistor and a fourth transistor, wherein the first transistor is coupled to a forward scan start signal outputted from a third transistor of a former second-stage shift register, coupled to an output signal of the former second-stage shift register, and coupled to a node; the second transistor is coupled to a reverse scan start signal outputted from a fourth transistor of a next second-stage shift register, coupled to an output signal outputted from the next second-stage shift register, and coupled to the node; the third transistor is coupled to a forward operation voltage and the node, and outputs a forward scan start signal; and the fourth transistor is coupled to a reverse operation voltage and the node, and outputs a reverse scan start signal.

10. The display panel according to claim 9, wherein in forward scanning, the shift register is initiated by the forward scan start signal of the former second-stage shift register, the forward operation voltage is a first reference voltage, and the reverse operation voltage is a second reference voltage.

11. The display panel according to claim 9, wherein in reverse scanning, the shift register is initiated by the reverse scan start signal of the next second-stage shift register, the forward operation voltage is the second reference voltage, and the reverse operation voltage is the first reference voltage.

12. The display panel according to claim 11, wherein the first transistor of a first-stage shift register of the shift registers has a first end and a second end coupled to a start signal outputted from a timing controller; and a third end coupled to the node.

13. The display panel according to claim 9, wherein the driving circuit further comprises:

one or more first dummy shift registers, disposed in front of first two-stage shift registers of the shift registers, for dropping down the output signals of the first two-stage shift registers; and one or more second dummy shift registers, disposed in back of last two-stage shift registers of the shift registers, for dropping down the output signals of the last two-stage shift registers.

14. The display panel according to claim 13, wherein each of the shift registers further comprises:

a fifth transistor to an eighth transistor, wherein the fifth transistor is coupled to the forward scan start signal outputted from the third transistor and coupled to the output signal outputted from the next second-stage shift register; the sixth transistor is coupled to the reverse scan start signal outputted from the fourth transistor and coupled to a start signal outputted from a timing controller; the seventh transistor is coupled to the output signal outputted from the next second-stage shift register and coupled to the output signal; and the eighth transistor is coupled to the start signal and the output signal.

15. The display panel according to claim 14, wherein each of the shift registers further comprises:

a ninth transistor and a tenth transistor, wherein the ninth transistor is coupled to a discharge signal and the node, the tenth transistor is coupled to the discharge signal and the output signal, wherein the discharge signal drops down a plurality of output signals and internal signals of the dummy shift registers in a blanking period.

16. The display panel according to claim 15, wherein the discharge signal further drops down the output signals and the internal signals of the shift registers in the blanking period.

* * * * *